US008944415B2

(12) United States Patent
Sirotin et al.

(10) Patent No.: US 8,944,415 B2
(45) Date of Patent: Feb. 3, 2015

(54) SECURITY ENCLOSURE

(75) Inventors: Justin Sirotin, Providence, RI (US); Ryan Coyle, Providence, RI (US); Raul G. Pereira, Cumberland, RI (US); Gaetano D. Desimone, Mansfield, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 322 days.

(21) Appl. No.: 13/440,675

(22) Filed: Apr. 5, 2012

(65) Prior Publication Data

US 2012/0256148 A1 Oct. 11, 2012

Related U.S. Application Data

(60) Provisional application No. 61/471,970, filed on Apr. 5, 2011.

(51) Int. Cl.
*E04H 17/16* (2006.01)
*E04H 17/20* (2006.01)
*E04H 17/00* (2006.01)

(52) U.S. Cl.
CPC ..... *E04H 17/20* (2013.01); *E04H 17/16* (2013.01); *E04H 2017/006* (2013.01)
USPC ..... 256/26

(58) Field of Classification Search
CPC ..... E04H 17/00; E04H 17/18; F16C 11/00
USPC ..... 403/326, 321, 325, 322.3, 315, 316, 97, 403/92–95, 103; 256/19, 24–27
See application file for complete search history.

(56) References Cited

U.S. PATENT DOCUMENTS

| | | | | | |
|---|---|---|---|---|---|
| 595,789 | A | * | 12/1897 | Smith | 256/26 |
| 753,443 | A | * | 3/1904 | St. Hilaire | 16/350 |
| 913,075 | A | | 2/1909 | Villard | |
| 2,011,528 | A | | 8/1935 | Seay | |
| 2,883,698 | A | | 4/1959 | Landry | |
| 4,030,161 | A | * | 6/1977 | Loikitz | 16/284 |
| 4,645,183 | A | | 2/1987 | Rattray et al. | |
| 4,692,963 | A | * | 9/1987 | Barroero | 16/275 |
| 4,697,306 | A | * | 10/1987 | Rhodes | 16/317 |
| 4,712,773 | A | | 12/1987 | Larson | |
| 5,025,517 | A | | 6/1991 | Johnson | |
| 5,265,848 | A | | 11/1993 | Michaud et al. | |
| 5,421,219 | A | | 6/1995 | Tagawa et al. | |
| 5,457,828 | A | | 10/1995 | Huang | |
| 5,544,870 | A | | 8/1996 | Kelley et al. | |
| 5,588,331 | A | | 12/1996 | Huang et al. | |
| 5,600,870 | A | * | 2/1997 | Fields et al. | 16/342 |

(Continued)

FOREIGN PATENT DOCUMENTS

| | | |
|---|---|---|
| DE | 310769 | 1/1956 |
| EP | 1157643 | 11/2001 |

(Continued)

*Primary Examiner* — Michael P Ferguson
*Assistant Examiner* — Daniel Wiley
(74) *Attorney, Agent, or Firm* — Barnes & Thornburg LLP

(57) ABSTRACT

A multi-sided security enclosure includes several wall units. The wall units are connected to one another in series to form a closed space bounded by the interconnected wall units. Each wall unit includes connectors and a pivot joint between wall units so that they may rotate about a vertical pivot axis to vary the included angle therebetween.

25 Claims, 22 Drawing Sheets

(56) References Cited

U.S. PATENT DOCUMENTS

| | | | | |
|---|---|---|---|---|
| 5,829,910 | A | 11/1998 | Kameyama | |
| 5,881,789 | A | 3/1999 | Melashenko et al. | |
| 5,893,573 | A | 4/1999 | Arbeiter | |
| 5,993,287 | A * | 11/1999 | Melashenko et al. | 446/478 |
| 6,021,688 | A | 2/2000 | Chang | |
| 6,027,104 | A | 2/2000 | Alexander et al. | |
| 6,067,875 | A | 5/2000 | Ritchey et al. | |
| 6,098,217 | A | 8/2000 | Hammil | |
| 6,123,321 | A | 9/2000 | Miller | |
| 6,161,334 | A * | 12/2000 | Goodin | 49/125 |
| 6,209,413 | B1 | 4/2001 | Chang | |
| 6,276,227 | B1 | 8/2001 | Ose | |
| 6,302,382 | B2 * | 10/2001 | Santelli, Jr. | 256/25 |
| 6,513,405 | B1 | 2/2003 | Sturmer et al. | |
| 6,595,498 | B1 | 7/2003 | Andersen | |
| 6,634,826 | B1 | 10/2003 | Marsetti | |
| 7,234,275 | B1 | 6/2007 | Haggy et al. | |
| 7,413,159 | B2 * | 8/2008 | Liang et al. | 248/676 |
| 7,516,935 | B2 * | 4/2009 | Liang et al. | 248/676 |
| 7,789,585 | B2 | 9/2010 | Christensen et al. | |
| 7,887,029 | B2 * | 2/2011 | Flannery | 256/73 |
| 2004/0025294 | A1 * | 2/2004 | Gruber | 16/254 |
| 2007/0210293 | A1 | 9/2007 | Cheng | |

FOREIGN PATENT DOCUMENTS

| | | |
|---|---|---|
| WO | 8401497 | 4/1984 |
| WO | 0227122 | 4/2002 |
| WO | 2010139387 | 12/2010 |

* cited by examiner

SECURITY ENCLOSURE

PRIORITY CLAIM

This application claims priority under 35 U.S.C. §119(e) to U.S. Provisional Application Ser. No. 61/471,970, filed Apr. 5, 2011, which is expressly incorporated by reference herein.

BACKGROUND

The present disclosure relates to a multi-panel enclosure, and in particular to an enclosure comprising a series of interconnected panels arranged to form an endless wall. More particularly, the present disclosure relates to an enclosure that can be assembled in the field by a caregiver to provide a play area for children and pets and then disassembled for storage or transport.

SUMMARY

A security enclosure in accordance with the present disclosure includes several wall units. The wall units are connected to one another in series to form a closed space bounded by the interconnected wall units that serves as a play area for children and pets.

In illustrative embodiments, the wall units that cooperate to form a security enclosure in accordance with the present disclosure are identical. For example, six wall units can be connected to form a hexagon-shaped security enclosure and eight wall units can be connected to form an octagon-shaped security enclosure.

Each wall unit includes a male-edge connector, a female-edge connector, and a panel arranged to extend between the male- and female-edge connectors and contact the ground underlying the panel when a security enclosure comprising the wall units is erected. The male-edge connector of one wall unit is mated to the female-edge connector of a neighboring wall unit to interconnect the companion pair of wall units to establish a play area bordered by the wall units. Later, if desired, the male- and female-edge connectors of the companion pair of wall units can be separated by a caregiver using a one-handed separation technique for easy transport or storage during breakdown of the security enclosure.

An illustrative wall unit includes a female-edge connector extending along the right side of the panel and a male-edge connector extending along the left side of the panel. An illustrative female-edge connector includes spaced-apart upper and lower rings and each ring is formed to include a post-receiving channel. An illustrative male-edge connector includes spaced-apart upper and lower ring mounts and each ring mount includes a post-support platform coupled to the panel and a pivot post anchored to the post-support platform.

To mate a right wall unit to a neighboring left wall unit in accordance with the present disclosure, the male-edge connector of the right wall unit is arranged to lie alongside the female-edge connector of the left wall unit. Then the pivot post of the upper ring mount of the right wall unit is passed into the post-receiving channel of the upper ring of the left wall unit while the pivot post of the lower ring mount of the right wall unit is passed into the post-receiving channel of the lower ring of the left wall unit to establish a pivot joint between the right and left wall units so that the left wall unit is free to pivot about a vertical pivot axis relative to the right wall unit to vary the included angle between the right and left wall units at the option of the caregiver.

An illustrative ring in the female-edge connector includes a circular inner wall and a series of inwardly projecting ratchet teeth coupled to the circular inner wall and arranged to cooperate with one another to form the post-receiving channel. These ratchet teeth are associated with the female-edge connector of the left wall unit and are arranged to extend radially inwardly toward a pivot post associated with the male-edge connector of an adjacent right wall unit and arranged to extend into the post-receiving channel to establish a pivot joint between the right and left wall units. A pocket is formed between each pair of neighboring ratchet teeth and these pockets are arranged to open radially inwardly toward the vertical pivot axis so as to receive a radially outwardly projecting ring-rotation blocker included in a pivot post inserted into the post-receiving channel. By trapping a ring-rotation blocker in the pivot post in one of these pockets, the right and left wall units are retained in stationary positions relative to one another to establish a fixed included angle therebetween.

An illustrative pivot post in the male-edge connector comprises a movable ring retainer including an elastic deflectable retainer tab, a ring-separation blocker, a ring-rotation blocker located between the post-support platform and the ring-separation blocker, and a tab-bender ramp arranged to lie in spaced-apart relation to the ring-rotation blocker to locate the ring-separation blocker therebetween. A root end of the elastic deflectable retainer tab is coupled to the post-support platform to free the axially extending retainer tab to bend toward and away from the vertical pivot axis during movement of the pivot post of a right wall unit into and out of the post-receiving channel formed in the companion ring of a left wall unit. Each of the ring-separation and ring-rotation blockers and the tab-bender ramp are coupled to an outer surface of the retainer tab to extend away from the vertical pivot axis while an opposite inner surface of the retainer tab faces toward the vertical pivot axis.

To mate the ring of the female-edge connector of the left wall unit to the pivot post of the male-edge connector of the right wall unit, the ring is first centered over the pivot post to align the free end of the pivot post with the vertical pivot axis passing through the post-receiving channel formed in the ring. Then the ring is moved axially relative to the pivot post and toward the post-support platform to cause (1) the elastic deflectable retainer tab to bend temporarily inwardly toward the vertical axis of rotation to allow the ring to move into and become trapped in a ring-retaining space provided between the post-support platform and the ring-separation blocker without limiting rotation of the ring on the pivot post so that the left wall unit is free to pivot about the vertical pivot axis relative to the right wall unit at the option of the caregiver and to cause (2) the ring-rotation blocker coupled to the outer surface of the elastic deflectable retainer tab to snap radially outwardly into a pocket formed between two neighboring ratchet teeth included in the ring so that the included angle between the right and left wall units is established. The caregiver is free to change the selected included angle between the right and left wall units by pivoting the left wall unit about the vertical pivot axis relative to the right wall unit to cause the ring-rotation blocker of the pivot post to ride in ratcheting relation on the ratchet teeth of the ring as the elastic deflectable retainer tab is moved relative to the vertical pivot axis during ratcheting movement of the ring-rotation blocker on the ratchet teeth until the ring-rotation blocker extends into a selected different pocket formed between another pair of neighboring ratchet teeth.

An illustrative locking cap included in the right wall unit includes a shell mounted for rotation about the vertical pivot axis on a free tip of the pivot post between a locked position and an unlocked position. The locking cap also includes a tab stop that is coupled to the shell to rotate therewith. In the locked position of the cap, the tab stop is arranged to lie in confronting relation to the inner surface of the elastic deflectable retainer tab to block inward bending movement of the free end of the retainer tab toward the vertical pivot axis so that the ring-rotation blocker is constrained to remain in the selected pocket and the ring of the left wall unit is constrained to remain in the ring-retaining space provided between the post-support platform and the ring-separation blocker included in the right wall unit. In the unlocked position of the cap, the tab stop is moved away from the inner surface of the elastic deflectable retainer tab to allow inward bending movement of the free end of the retainer tab toward the vertical pivot axis to move the ring-separation blocker radially inwardly away from the ring so that ratcheting movement of the ring-rotation blocker of the pivot post on the ratchet teeth of the ring is allowed to facilitate pivotable movement of the left wall unit about the vertical pivot axis relative to the right wall unit and so that the ring can be removed from the space to facilitate separation of the ring from the pivot post leading to separation of the left wall unit from the right wall unit.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 5 is an enlarged partial perspective view showing an initial stage of mating the upper ring with the upper ring mount in which the upper ring slides downwardly over the upper ring mount to cause the pair of retainer tabs included in the ring mount to deflect radially inward toward the vertical pivot axis as suggested in FIG. 6;

FIG. 6 is a sectional view taken along line 6-6 of FIG. 5 showing both retainer tabs moving radially inward toward one another in response to the upper ring sliding downwardly over a ring-separation blocker that is coupled to the retainer tab;

FIG. 7 is an enlarged partial perspective view showing the initial stage of mating the lower ring with the lower ring mount in which the lower ring slides downwardly over the lower ring mount;

FIG. 8 is a sectional view taken along line 8-8 of FIG. 7;

FIG. 9 is a view similar to FIG. 5 showing the final stage of mating the upper ring on the upper ring mount in which the upper ring has moved downwardly and is supported by a post-support platform included in the ring mount;

FIG. 10 is a sectional view taken along line 10-10 of FIG. 9 showing both retainer tabs have returned to their initial upright position as a result of the upper ring moving past the ring-separation blocker that is coupled to the retainer tab;

FIG. 11 is a view similar to FIG. 7 showing the final stage of mating the lower ring to the lower ring mount;

FIG. 12 is a sectional view taken along line 12-12 of FIG. 11;

FIG. 13 is an enlarged partial perspective view showing the initial stage of installing the lock cap on the upper pivot joint;

FIG. 14 is a sectional view taken along line 14-14 of FIG. 13;

FIG. 15 is a view similar to FIG. 13 showing the lock cap has been aligned with the ring mount along the vertical pivot axis so that each ring-separation blocker is arranged to extend through a companion ring-separation blocker slot formed in the locking cap when the locking cap is in the installed position as suggested in FIG. 17;

FIG. 16 is a sectional view taken along line 16-16 of FIG. 15;

FIG. 17 is a view similar to FIG. 15 showing the locking cap in a freed unlocked position in which movement of the right and left wall units about the vertical pivot axis is allowed and separation of the left wall unit from the right wall unit is allowed as suggested in FIG. 22-24;

FIG. 18 is a sectional view taken along line 18-18 of FIG. 17;

FIGS. 17-21 are a series of views showing movement of the locking cap from the unlocked position to a locked position;

FIG. 19 is a sectional view taken along line 19-19 of FIG. 17 showing that the tab stops included in the locking cap are spaced-apart inwardly from a shell included in the cap so that a ring-retainer space is formed between each tab stop and the shell;

FIG. 20 is a view similar to FIG. 17 showing the locking cap in the locked position;

FIG. 21 is a sectional view taken along line 21-21 of FIG. 20 showing that tab stops are arranged at the twelve o'clock position and the six o'clock position so that companion retainer tabs are trapped between the tab stops and the shell of the locking cap thereby blocking radially inward movement of the retainer tabs toward the vertical pivot axis;

FIG. 22 is a perspective view showing a caregiver holding a child and opening the security enclosure of FIG. 1 using one hand lift to apply an upward force to the left wall unit after the locking cap has been moved to the unlocked position and showing the caregiver's left foot inserted into a grip aperture formed in the panel of the right wall unit so that left wall unit may be lifted upwardly as suggested in FIGS. 23 and 24;

FIG. 23 is an enlarged partial perspective view of the grip aperture formed in the panel of the left wall unit suggesting that the caregiver is applying the upward force which is sufficient to move the retainer tabs inwardly and free the left wall unit for upward movement relative to the right wall unit;

FIG. 24 is a view similar to FIG. 23 showing upward movement of the left wall unit relative to the right wall unit in response to application of the upward force applied to the left wall unit;

DETAILED DESCRIPTION

Figure 1:
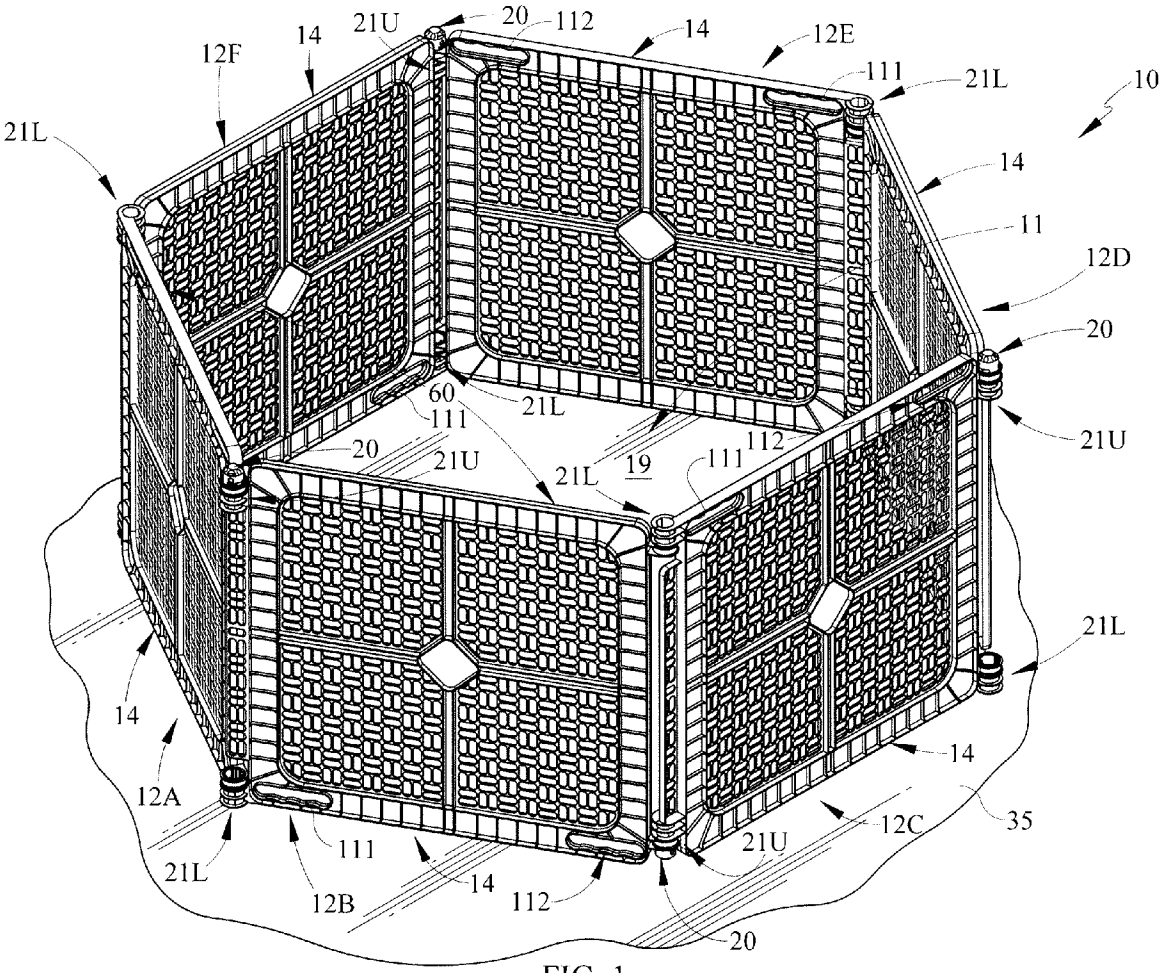
FIG. 1 is a perspective view of a security enclosure including six wall units coupled together to define a hexagon shape of the security enclosure.
Figure 2:
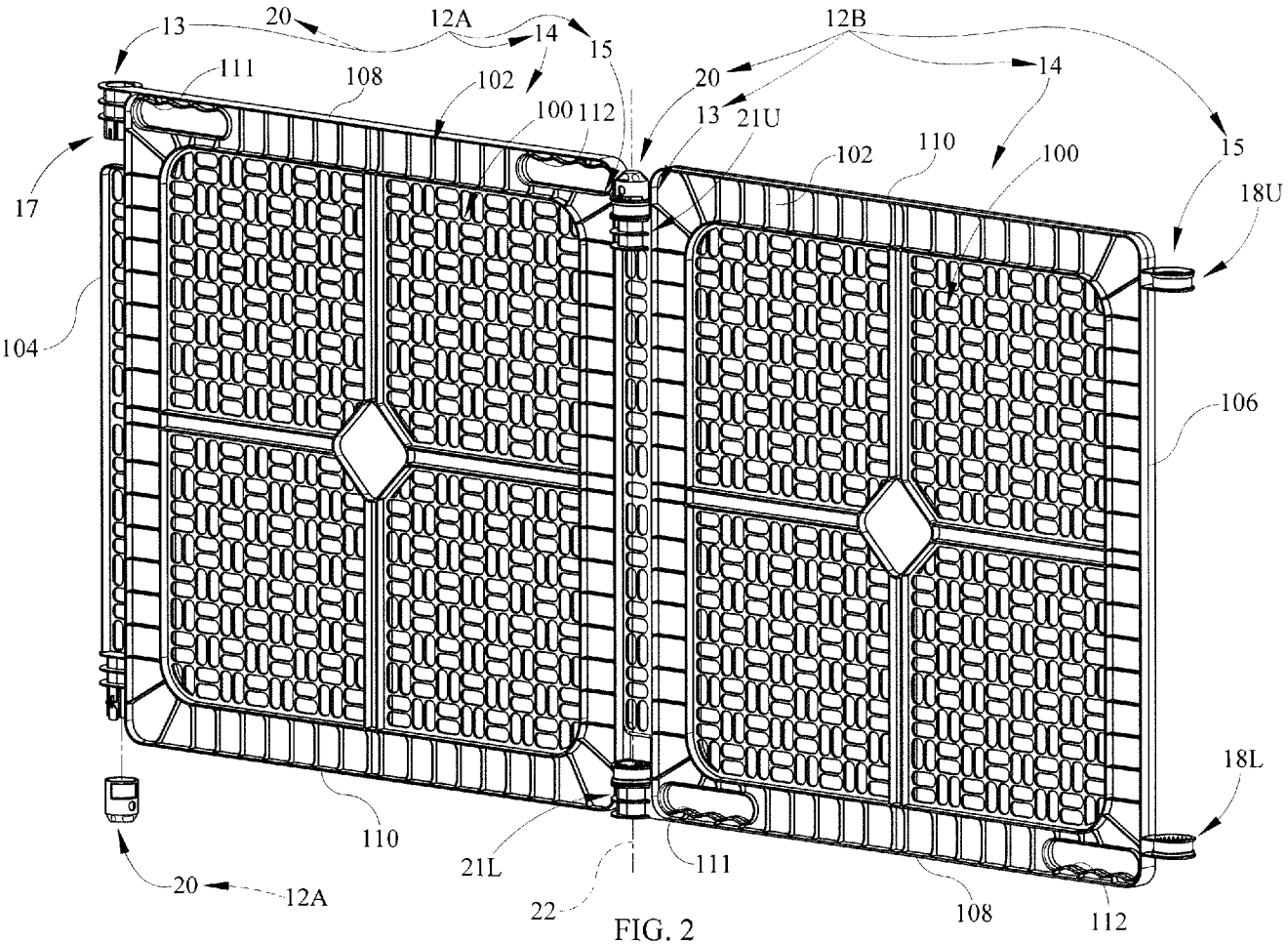
FIG. 2 is a perspective view of the right and left wall units included in the security enclosure of FIG. 1 showing the right and left wall units coupled together at a vertical pivot axis.
Figure 3:
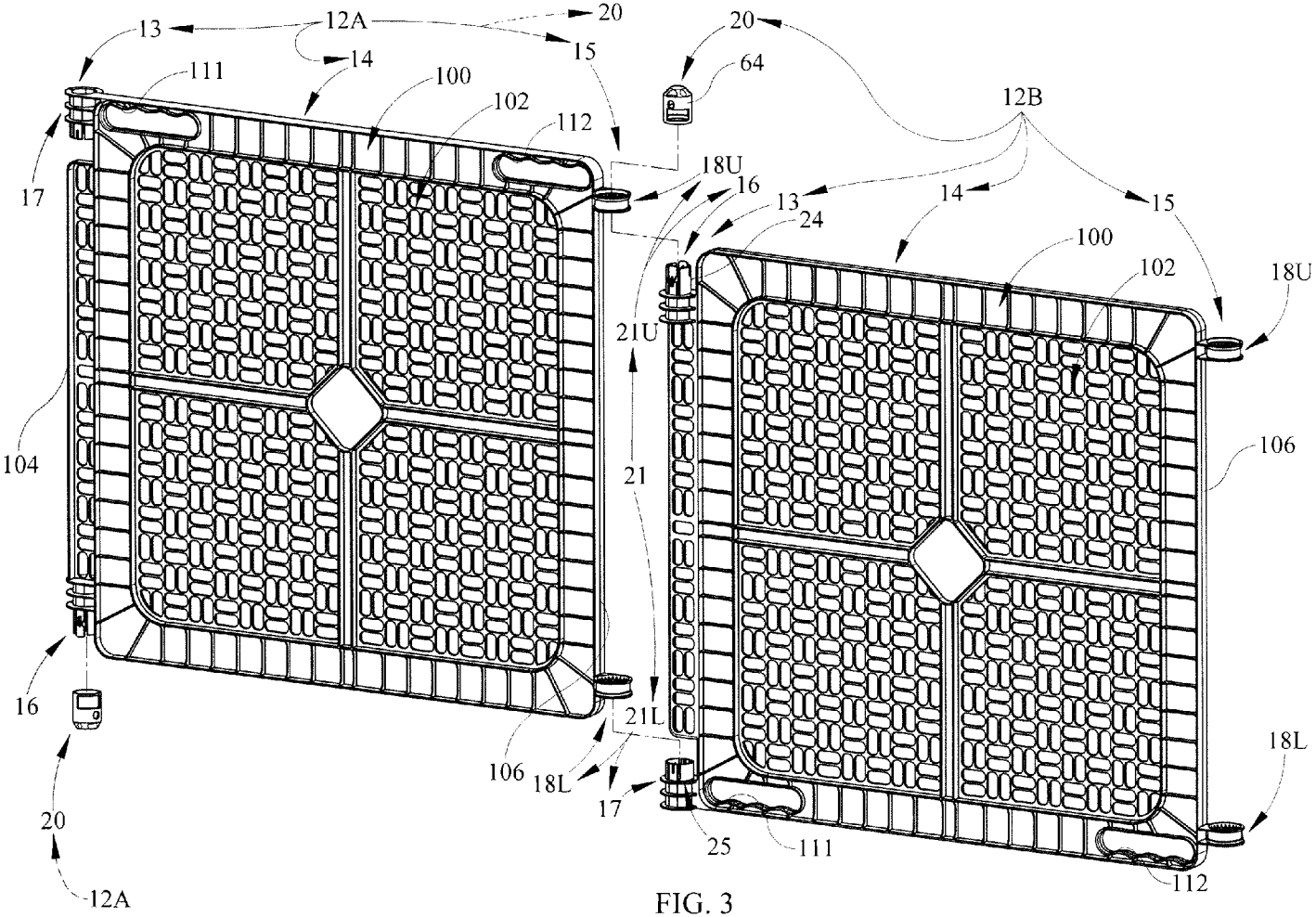
FIG. 3 is an enlarged exploded assembly view of the right and left wall units suggesting that a pair of rings included in a female-edge connector of the left wall unit slide over a companion pair of mating ring mounts included in a male-edge connector of the right wall unit to establish a pivot joint that permits pivotable movement of the right wall unit about the vertical pivot axis relative to the left wall unit, and suggesting that a locking cap is coupled to the pivot joint to block rotation and separation of the wall units.

A security enclosure 10 in accordance with the present disclosure includes several wall units 12A, 12B, 12C, 12D, 12E, and 12F as shown in FIG. 1. Wall units 12A, 12B, 12C, 12D, 12E, and 12F are connected to one another in series to form a closed space 11 bounded by interconnected wall units 12A, 12B, 12C, 12D, 12E, and 12F that serves as a play area for children and pets. As shown in FIGS. 2 and 3, wall units 12A, 12B, 12C, 12D, 12E, and 12F that cooperate to form security enclosure 10 are identical. For example, six wall units 12A, 12B, 12C, 12D, 12E, and 12F can be connected to form a hexagon-shaped security enclosure 10 and eight wall units can be connected to form an octagon-shaped security enclosure.

Each wall unit 12 includes a male-edge connector 13, a female-edge connector 15, and a panel 14 that is arranged to extend between male- and female-edge connectors 13, 15 and contact ground 35 underlying panel 14 when security enclosure 10 comprising wall units 12A, 12B, 12C, 12D, 12E, and 12F is erected as shown in FIG. 1. Male-edge connector 13 of right (second) wall unit 12B is mated to female-edge connector 15 of neighboring left (first) wall unit 12A to interconnect companion pair of wall units 12A, 12B to establish a play area 19 bordered by wall units 12A, 12B, 12C, 12D, 12E, and 12F. Later, if desired, male- and female-edge connectors 13, 15 of companion wall units 12A, 12B can be separated by a caregiver 52 using a one-handed separation technique for easy transport or storage during breakdown of security enclosure 10 as suggested in FIG. 22.

Illustrative wall unit 12A includes female-edge connector 15 extending along a right side of panel 14 and male-edge connector 13 extending along a left side of panel 14 as shown in FIGS. 2 and 3. Female-edge connector 15 includes spaced-apart upper and lower rings 18U, 18L and each ring 18U, 18L is formed to include a post-receiving channel 61. Male-edge connector 13 includes an upper ring mount 16 and a lower ring mount 17 spaced-apart from upper ring mount 16. Upper ring mount 16 includes a post-support platform 26 and an upper pivot post 24 configured to mate with and retain ring 18 thereon. Lower ring mount 17 includes post-support platform 26 and a lower pivot post 25 as shown in FIG. 4.

Figure 4:
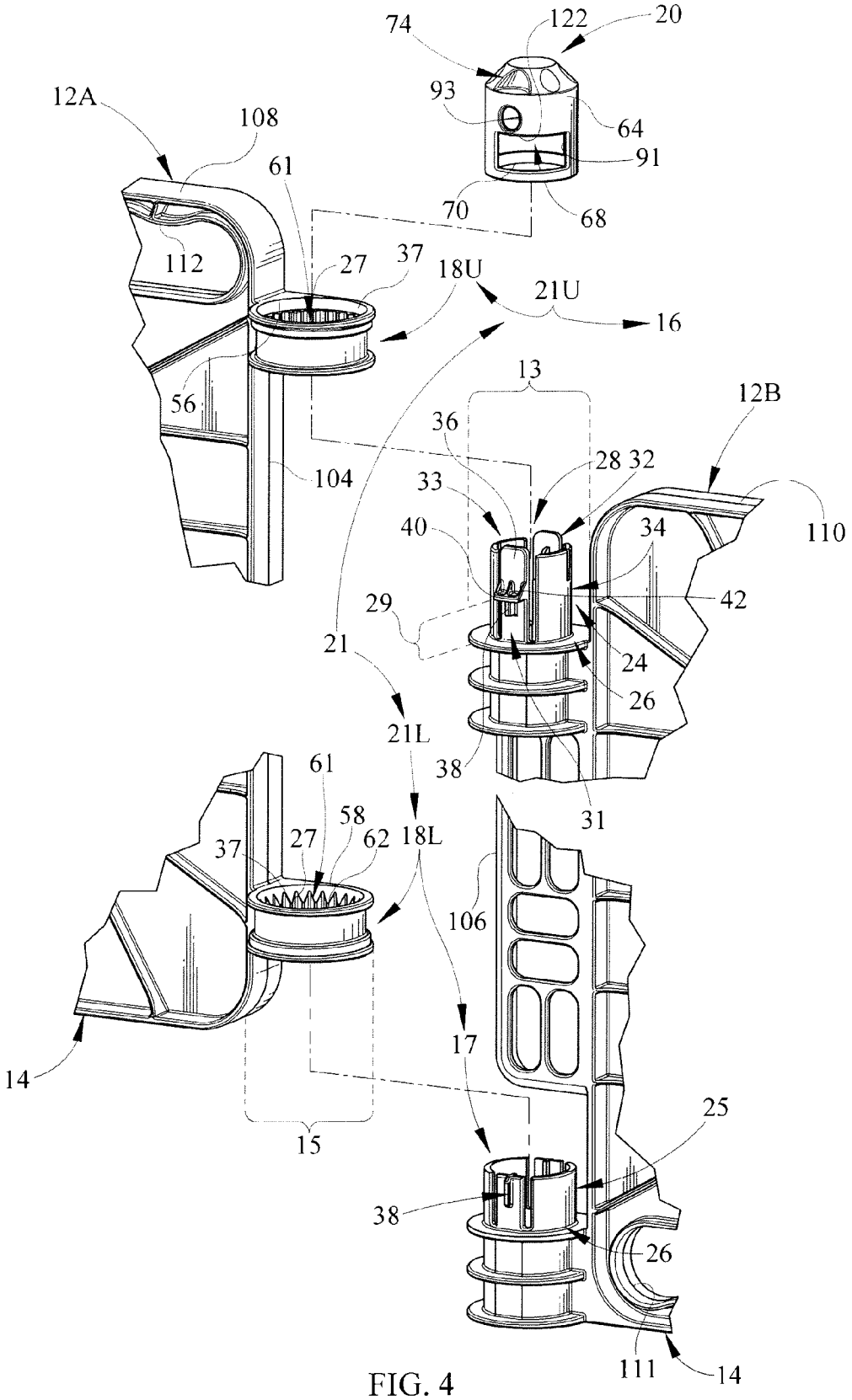
FIG. 4 is an enlarged exploded assembly view of the pivot joint of FIG. 3 showing that the pivot joint includes an upper pivot joint including an upper ring and a companion upper pivot mount and a lower pivot joint including a lower ring and a companion lower pivot mount, and suggesting that the locking cap may be coupled to the upper pivot coupling to block movement and separation of the right and left wall units.

Right wall unit 12A, also called first wall unit 12A, is mated to neighboring left wall unit 12B, also called second wall unit 12B, by aligning male-edge connector 13 of second wall unit 12B alongside female-edge connector 15 of first wall unit 12A as illustrated in FIGS. 3 and 4. Then upper pivot post 24 of upper ring mount 16 of second wall unit 12B is passed into post-receiving channel 61 of upper ring 18U of first wall unit 12A to establish an upper pivot joint 21U. At the same time, lower pivot post 25 of lower ring mount 17 of second wall unit 12B is passed into post-receiving channel 61 of lower ring 18L of first wall unit 12A to establish a lower pivot joint 21L. Upper and lower pivot joints 21U, 21L cooperate to establish a pivot joint 21 between first and second wall units 12A, 12B so that second wall unit 12B is free to pivot about a vertical pivot axis 22 relative to first wall unit 12A to vary an included angle 60 between first and second wall units 12A, 12B at the option of caregiver 52 as shown in FIG. 1.

Figure 19:
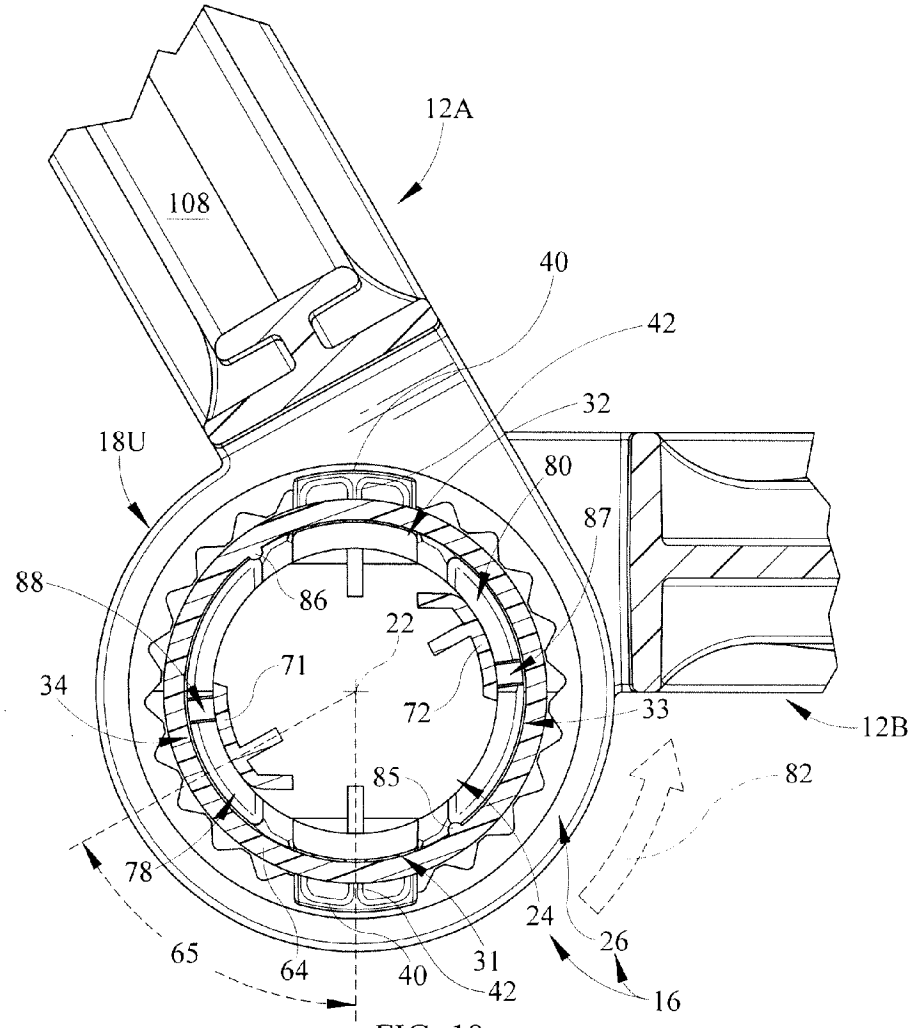
Figure 21:
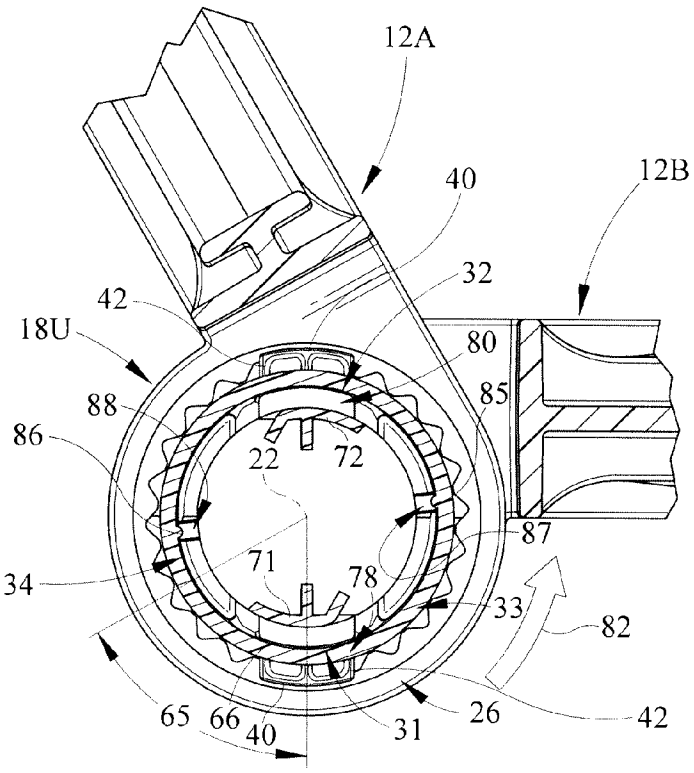

Ring 18 included in female-edge connector 15 includes a circular inner wall 23 and a series of inwardly projecting ratchet teeth 27 coupled to circular inner wall 23 and arranged to cooperate with one another to form post-receiving channel 61 as shown in FIGS. 19 and 21. Ratchet teeth 27 are associated with female-edge connector 15 of first wall unit 12A and are arranged to extend radially inwardly toward pivot post 24, 25 associated with male-edge connector 13 of adjacent second wall unit 12B. Ratchet teeth 27 are arranged to extend into post-receiving channel 61 to establish pivot joint 21 between first and second wall units 12A, 12B. An interdental pocket 62 is formed between each pair of neighboring ratchet teeth 27 and these interdental pockets 62 are arranged to open radially inwardly toward vertical pivot axis 22 so as to receive a radially outwardly projecting ring-rotation blocker 38 that is included in pivot posts 24, 25 that have been inserted into post-receiving channels 61. By trapping ring-rotation blocker 38 in pivot post 24, 25 in one of these pockets 62, first and second wall units 12A, 12B are retained in stationary positions relative to one another to establish a fixed included angle therebetween as shown, for example, in FIG. 1.

Figure 4A:
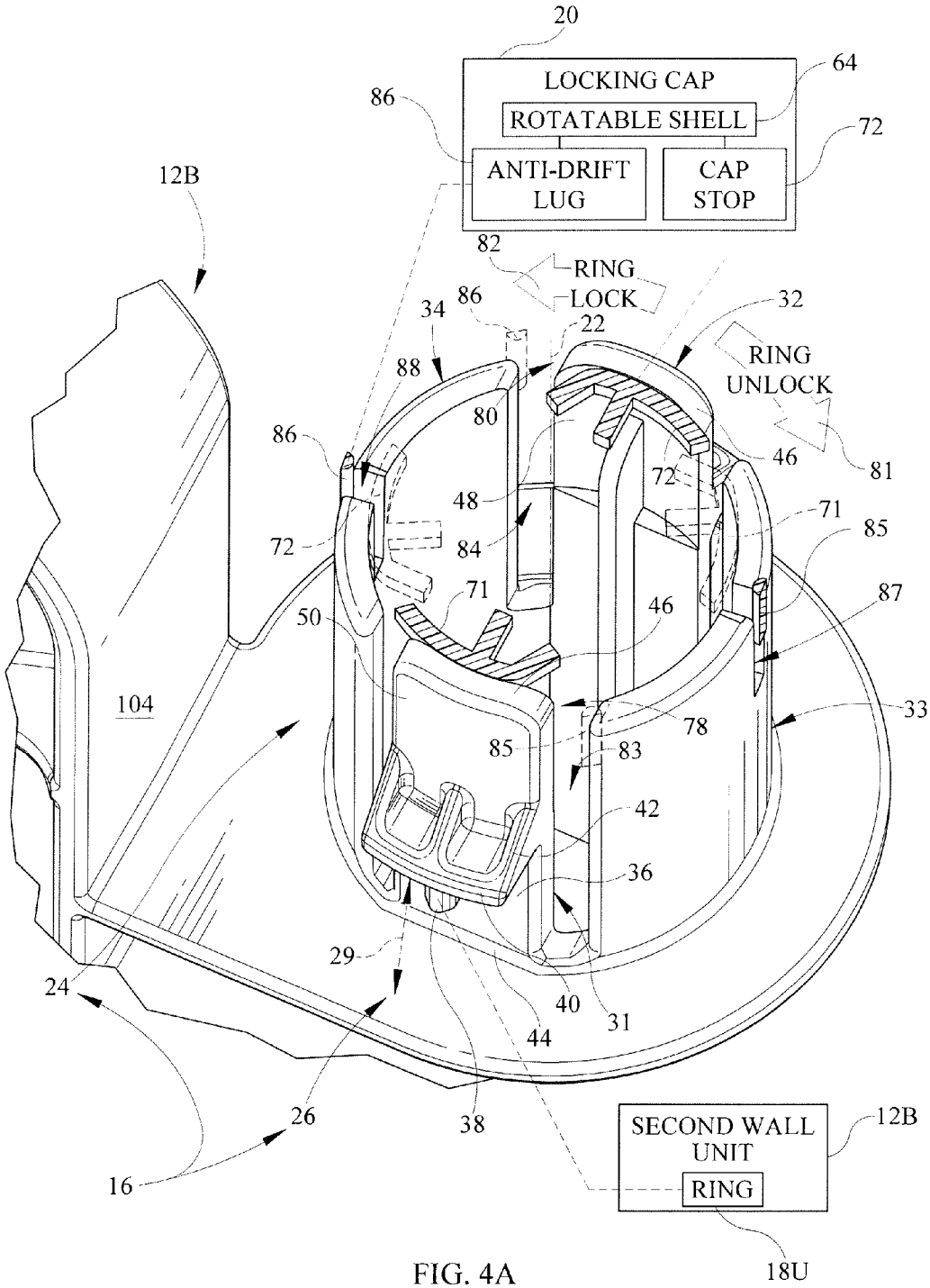
FIG. 4A is a partial perspective and diagrammatic view showing the locking cap of FIGS. 1-4 includes a pair of spaced-apart tab stops and a pair of spaced-apart anti-drift lugs and suggesting that the locking cap locks the right wall unit and the left wall unit in place by blocking radially inward deflection of a pair of retainer tabs included in the ring mount when the tab stops are positioned behind the ring retainers.
Figure 6:
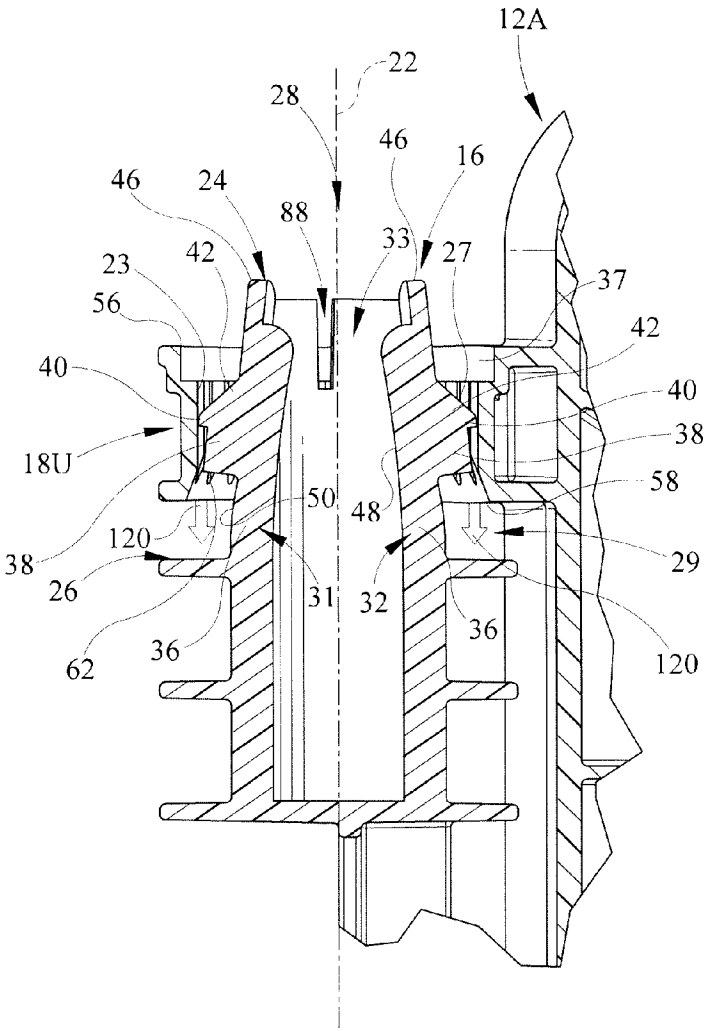
FIGS. 5-12 are a series of views showing initial coupling of the left wall unit to the right wall unit to establish the pivot joint.
Figure 5:
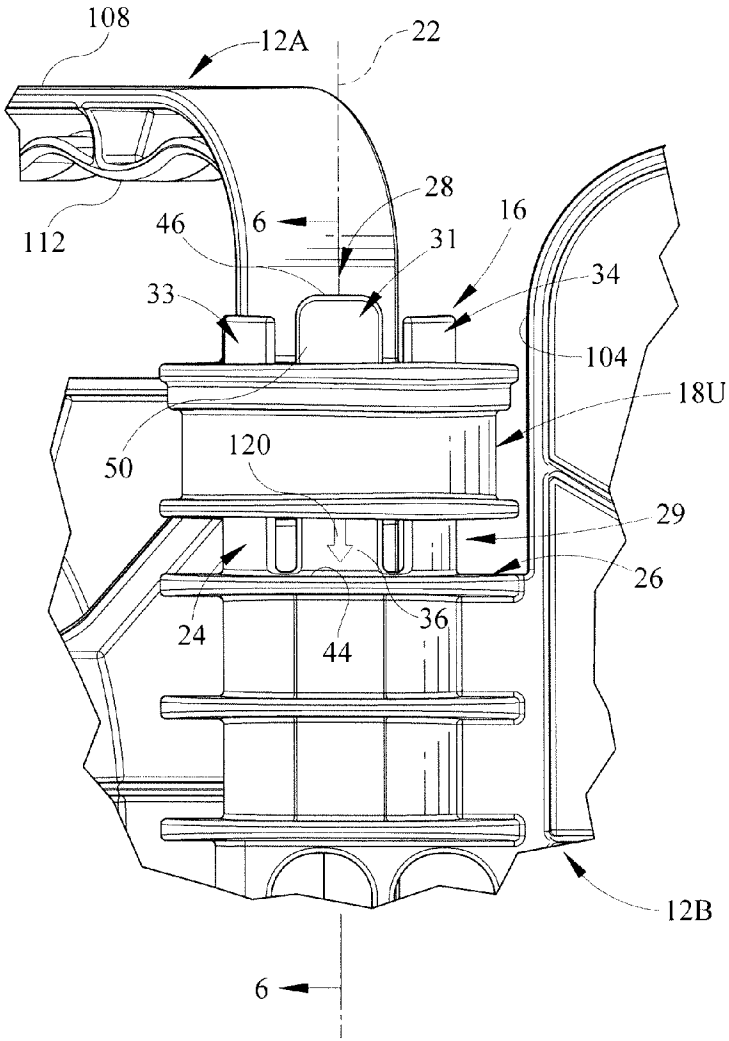
Figure 8:
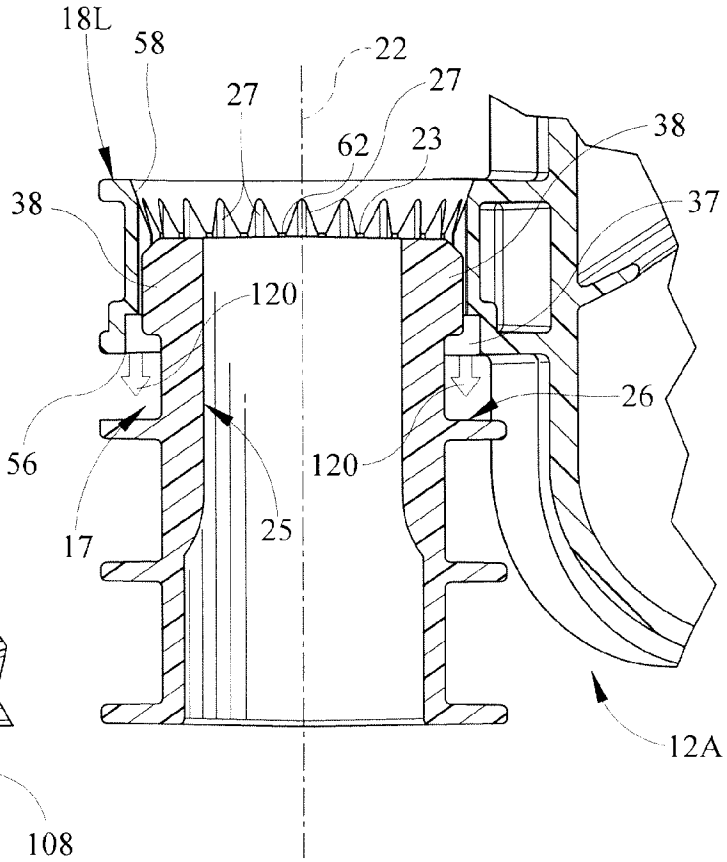
Figure 7:
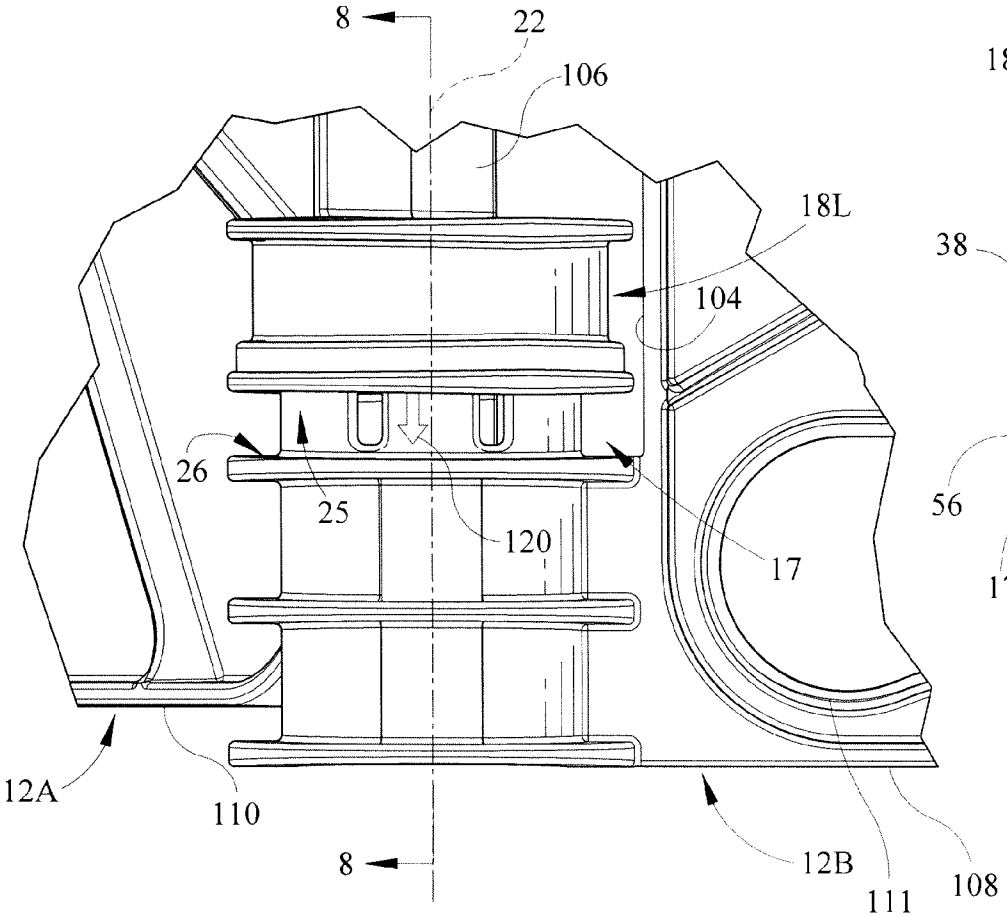

Upper pivot post 24 included in male-edge connector 13 includes an elastic deflectable retainer tab 36, a ring-separation blocker 40, a ring-rotation blocker 38 located between post-support platform 26 and ring-separation blocker 40, and a tab-bender ramp 42 arranged to lie in spaced-apart relation to ring-rotation blocker 38 to locate ring-separation blocker 40 therebetween as shown in FIG. 4A. A root end 44 of elastic deflectable retainer tab 36 is coupled to post-support platform 26 to free axially extending retainer tab 36 to bend toward and away from vertical pivot axis 22 during movement of pivot post 24 of second wall unit 12B into and out of post-receiving channel 61 formed in companion upper ring 180 of first wall unit 12A as shown in FIGS. 5 and 6. Each of ring-separation and ring-rotation blockers 38, 40 and tab-bender ramp 42 are coupled to an outer surface 50 of retainer tab 36 to extend away from vertical pivot axis 22 while an opposite inner surface 48 of retainer tab 36 faces toward vertical pivot axis 22 as shown in FIG. 6.

Upper ring 18U of female-edge connector 15 of first wall unit 12A is mated to pivot post 24 of male-edge connector 13 of second wall unit 12B by first centering upper ring 18U over upper pivot post 24U to align a free end 28 of upper pivot post 24U with vertical pivot axis 22 passing through post-receiving channel 61 formed in upper ring 18U as suggested in FIGS. 3 and 4. Upper ring 18U is then moved axially relative to upper pivot post 24U and toward post-support platform 26 to cause (1) elastic deflectable retainer tab 36 to bend temporarily inwardly toward vertical pivot axis 22 of rotation to allow upper ring 18U to move into and become trapped in a ring-retaining space 29 provided between post-support platform 26 and ring-separation blocker 40 without limiting rotation of upper ring 18U on upper pivot post 24U so that second wall unit 12B is free to pivot about vertical pivot axis 22 relative to first wall unit 12A at the option of caregiver 52 and to cause (2) ring-rotation blocker 38 coupled to outer surface 50 of elastic deflectable retainer tab 36 to snap radially outwardly into interdental pocket 62 formed between two neighboring ratchet teeth 27 included in upper ring 18U so that the included angle between first and second wall units 12A, 12B is established.

Caregiver 52 is free to change the selected included angle between first and second wall units 12A, 12B by pivoting second wall unit 12B about vertical pivot axis 22 relative to first wall unit 12A. Caregiver's movement of second wall unit 12B causes ring-rotation blocker 38 of upper pivot post 24U to ride in ratcheting relation on ratchet teeth 27 of upper ring 18U as elastic deflectable retainer tab 36 is moved relative to vertical pivot axis 22 during ratcheting movement of ring-rotation blocker 38 on ratchet teeth 27 until ring-rotation blocker 38 extends into a selected different interdental pocket 62 formed between another pair of neighboring ratchet teeth 27.

Figure 17:
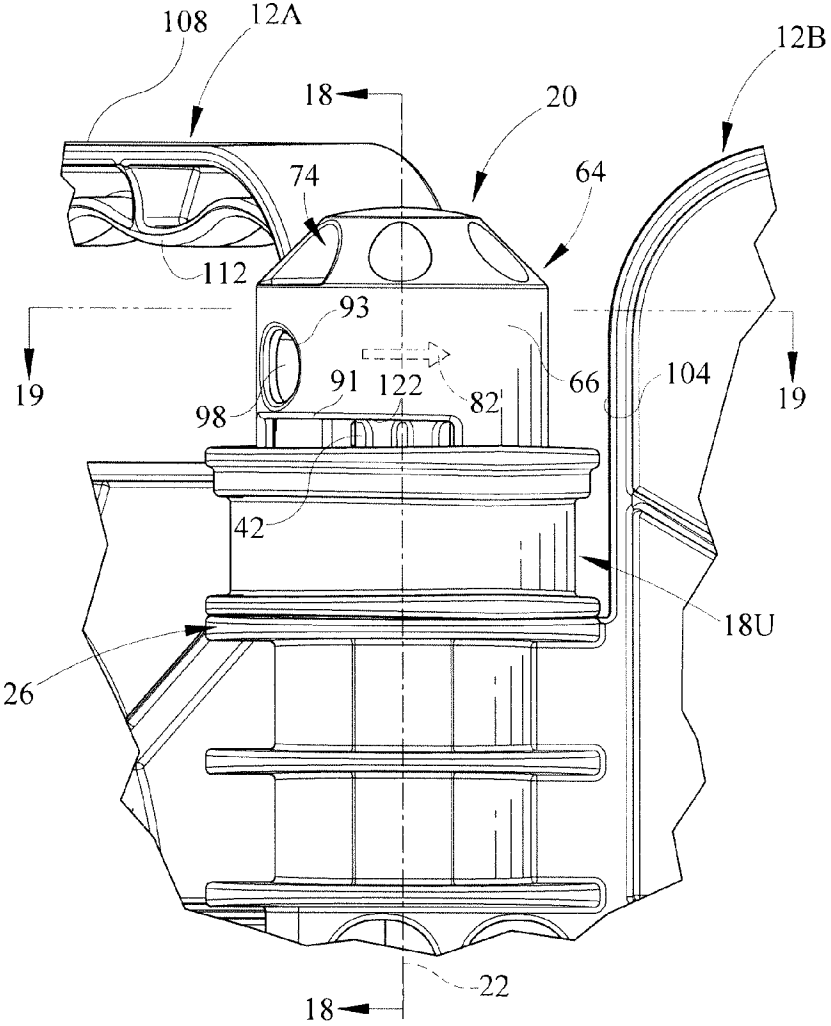
Figure 20:
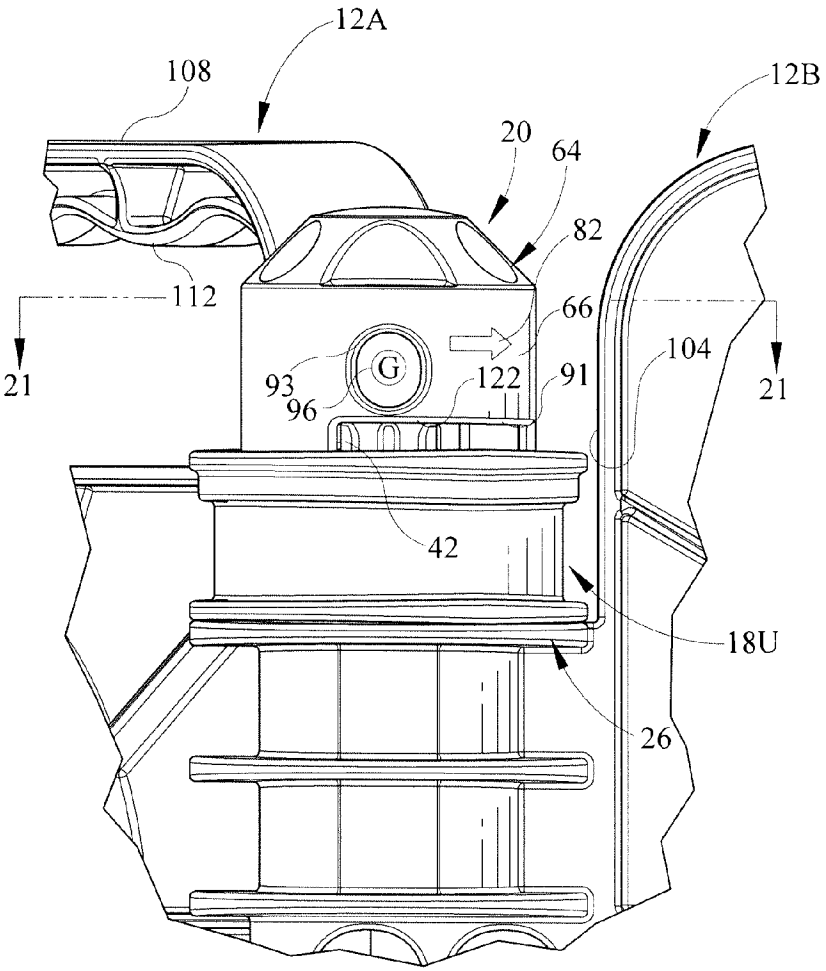

Locking cap 20 included in each wall unit 12A, 12B, 12C, 12D, 12E, 12F includes a shell 64 mounted for rotation about vertical pivot axis 22 on free end 28 of upper pivot post 24U between a locked position, as shown in FIGS. 20 and 21, and an unlocked position as shown in FIGS. 17 and 19. Locking cap 20 also includes a tab stop 71 that is coupled to shell 64 to rotate therewith. In the locked position of locking cap 20, tab stop 71 is arranged to lie in confronting relation to inner surface 48 of elastic deflectable retainer tab 36 to block inward bending movement of free end 46 of retainer tab 36 toward vertical pivot axis 22 so that ring-rotation blocker 38 is constrained to remain in selected interdental pocket 62 and upper ring 18U of first wall unit 12A is constrained to remain in ring-retaining space 29 provided between post-support platform 26 and ring-separation blocker 40 included in second wall unit 12B.

Figure 23:
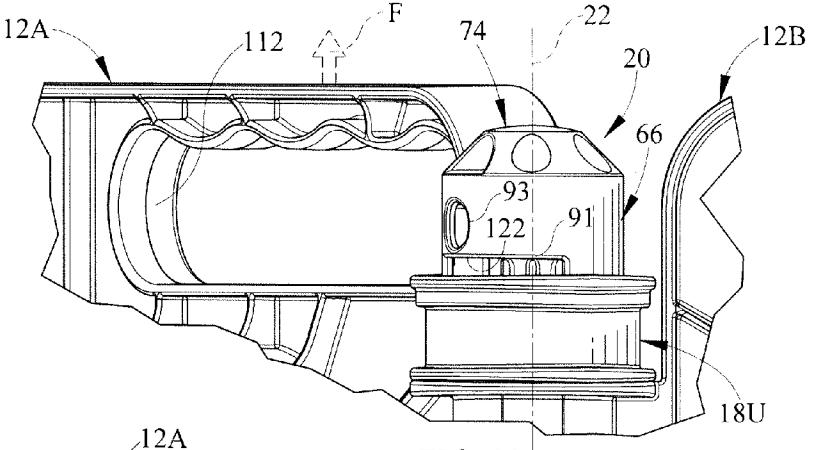
Figure 24:
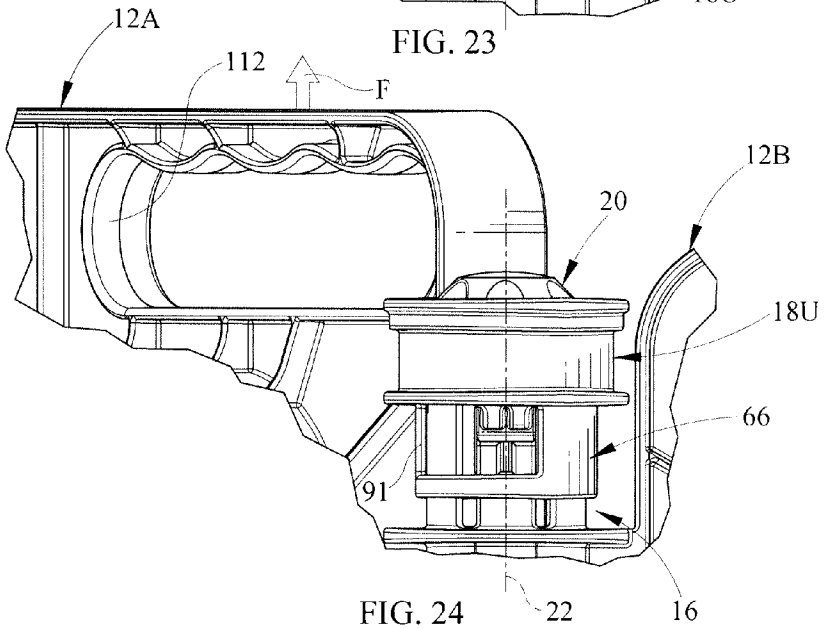

In the unlocked position of locking cap 20, tab stop 71 is moved away from inner surface 48 of elastic deflectable retainer tab 36 to allow inward bending movement of free end 46 of retainer tab 36 toward vertical pivot axis 22 to move ring-separation blocker 40 radially inwardly away from upper ring 18U so that ratcheting movement of ring-rotation blocker 38 of upper pivot post 24U on ratchet teeth 27 of upper ring 18U is allowed to facilitate pivotable movement of second wall unit 12B about vertical pivot axis 22 relative to first wall unit 12A and so that upper ring 18U can be removed from ring-retaining space 29 to facilitate separation of upper ring 18U from upper pivot post 24 leading to separation of second wall unit 12B from first wall unit 12A as shown in FIGS. 23 and 24.

Security enclosure 10 includes six wall units 12A, 12B, 12C, 12D, 12E, and 12F as shown in FIG. 1. Each wall unit includes panel 14, male-edge connector 13, and female-edge connector 15 spaced-apart from male-edge connector 13, and locking cap 20. Male-edge connector 13 includes upper ring mount 16, lower ring mount 17 spaced-apart from upper ring mount 16, and locking cap 20 as shown in FIGS. 2 and 3. Female-edge connector 15 includes upper ring 18U and lower ring 18L. Security enclosure 10 is formed by coupling each wall unit to two adjacent wall units. As shown in FIG. 1, first wall unit 12A is coupled on a right side to second wall unit 12B and on a left side to sixth wall unit 12F. Locking cap 20 is coupled to upper ring mount 16 to block separation of first wall unit 12A from second wall unit 12B and to block rotation of second wall unit 12B relative to first wall unit 12A about vertical pivot axis 22.

First wall unit 12A is coupled to second wall unit 12B for rotation about vertical pivot axis 22 relative to second wall unit 12B. As suggested in FIGS. 3 and 4, first wall unit 12A is coupled to second wall unit 12B by sliding upper ring 18U of first wall unit 12A over upper ring mount 16 of second wall unit 12B. First wall unit 12A is retained in position on second wall unit 12B by locking cap 20. Locking cap 20 is movable from the freed unlocked position illustrated in FIG. 13-19 to the locked position illustrated in FIGS. 4A, 20, and 21. When locking cap 20 is in the unlocked position, first wall unit 12A is free to pivot about vertical pivot axis 22 relative to second wall unit 12B and free to be separated from second wall unit 12B. When locking cap 20 is in the locked position, first wall unit 12A is fixed in position relative to second wall unit 12B and may not be separated from second wall unit 12B.

Figure 10:
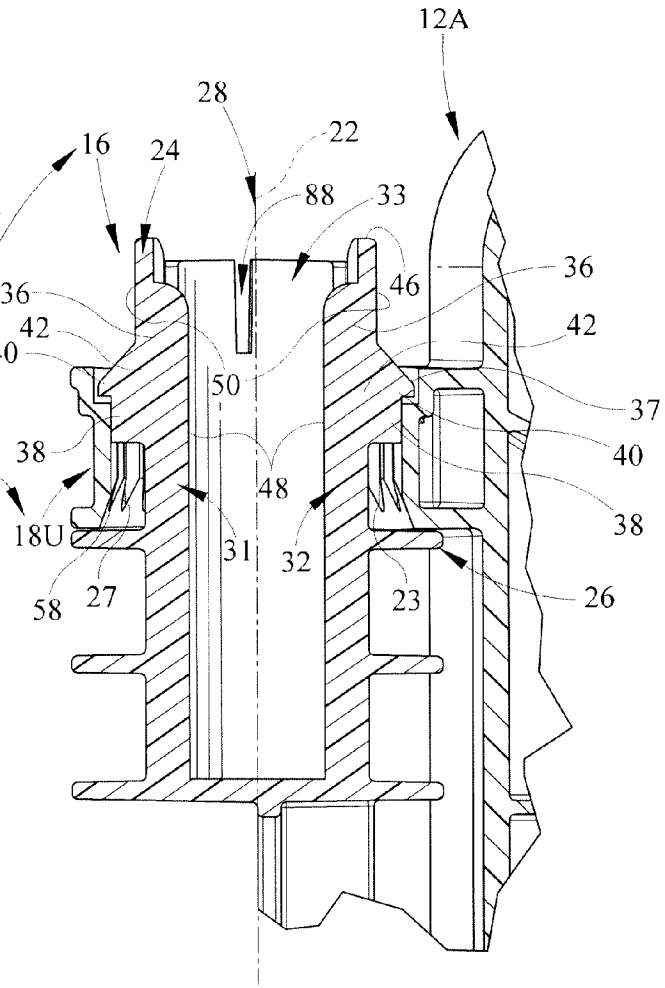
Figure 9:
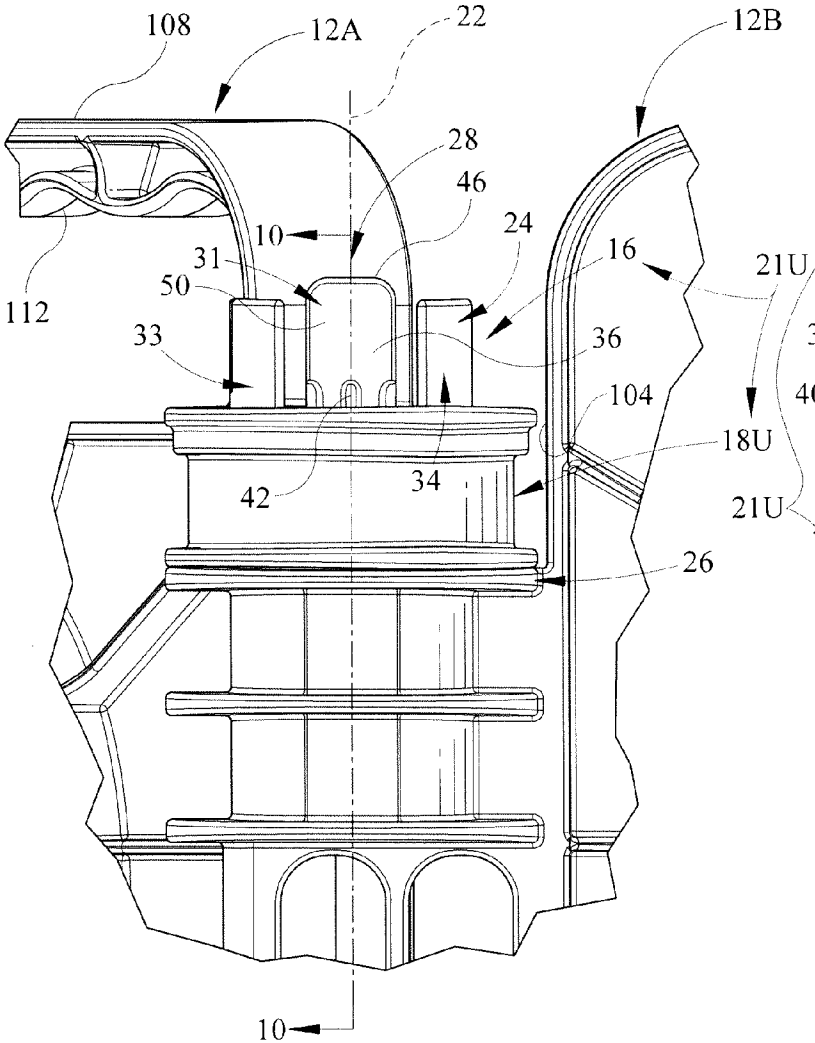
Figure 12:
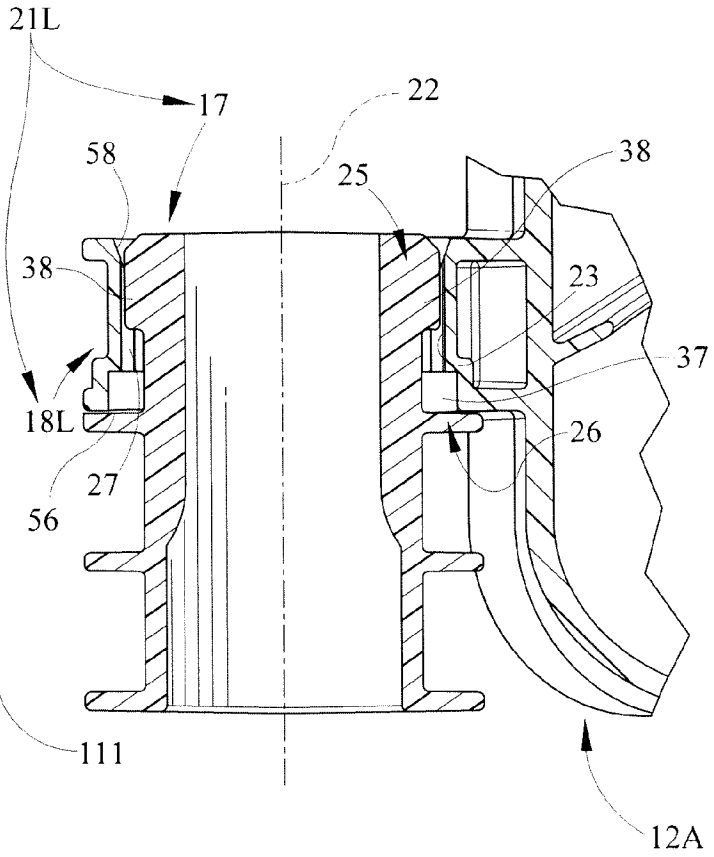
Figure 11:
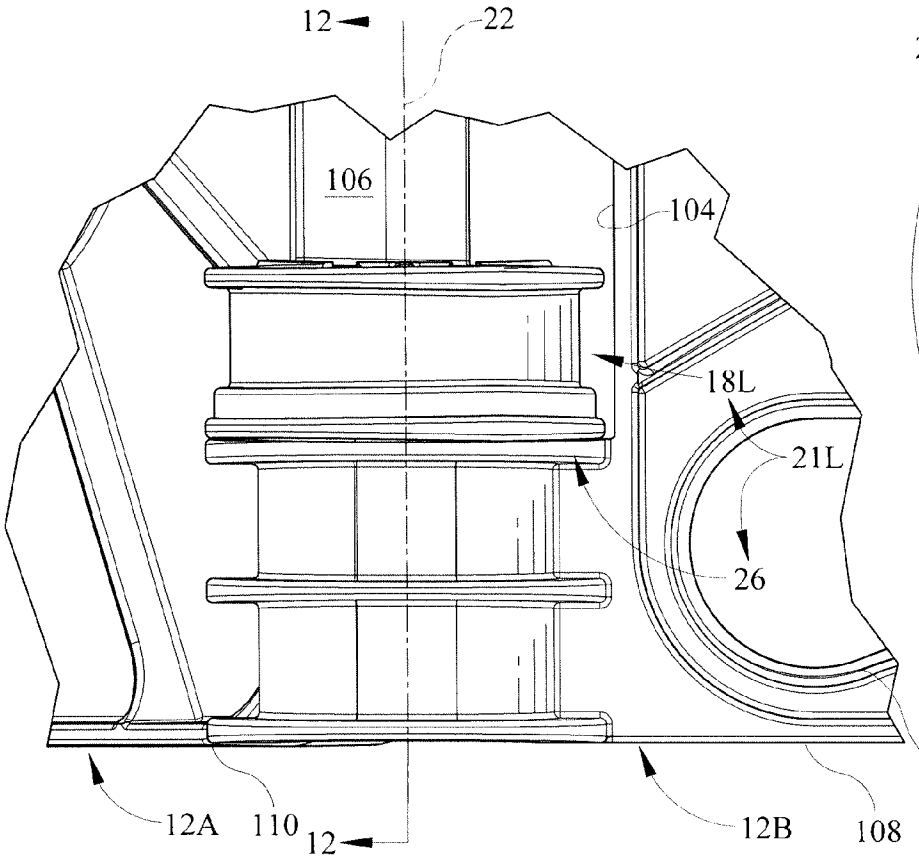

Upper ring mount 16 includes upper pivot post 24U and post-support platform 26 as shown in FIG. 4A. Post-support platform 26 is coupled to a post side 28 of first wall unit 12A and is arranged to extend away from first wall unit 12A toward second wall unit 12B. Upper pivot post 24U is coupled to post-support platform 26 and arranged to extend away from post-support platform 26 as shown in FIGS. 3-4A. Upper ring 18U included in adjacent female-edge connector 15 of first wall unit 12A is arranged to slide over upper pivot post 24U and be supported by post-support platform 26 as shown in FIGS. 9 and 10.

Upper pivot post 24U includes a movable first ring retainer 31, a movable second ring retainer 32, a curved inner stationary flange 33, and a curved outer stationary flange 34 as shown in FIG. 4A Inner stationary flange 33 is coupled to post-support platform 26 and is arranged to face toward post side 28 of first wall unit 12A as shown in FIG. 4A. Curved outer stationary flange 34 is positioned to lie in spaced-apart relation to inner stationary flange 33 and is arranged to face toward second wall unit 12B when first wall unit 12A is coupled to second wall unit 12B. First ring retainer 31 is coupled to post-support platform 26 for deformable movement relative to post-support platform 26. First ring retainer 31 is positioned to lie between inner and outer stationary flanges 33, 34 as illustrated in FIG. 4A. Second ring retainer 32 is coupled to post-support platform 26 for deformable movement relative to post-support platform 26. Second ring retainer 32 is positioned to lie in spaced-apart relation to first ring retainer 31 and positioned to lie between inner and outer stationary flanges 33, 34 as illustrated in FIG. 4A.

Figure 16:
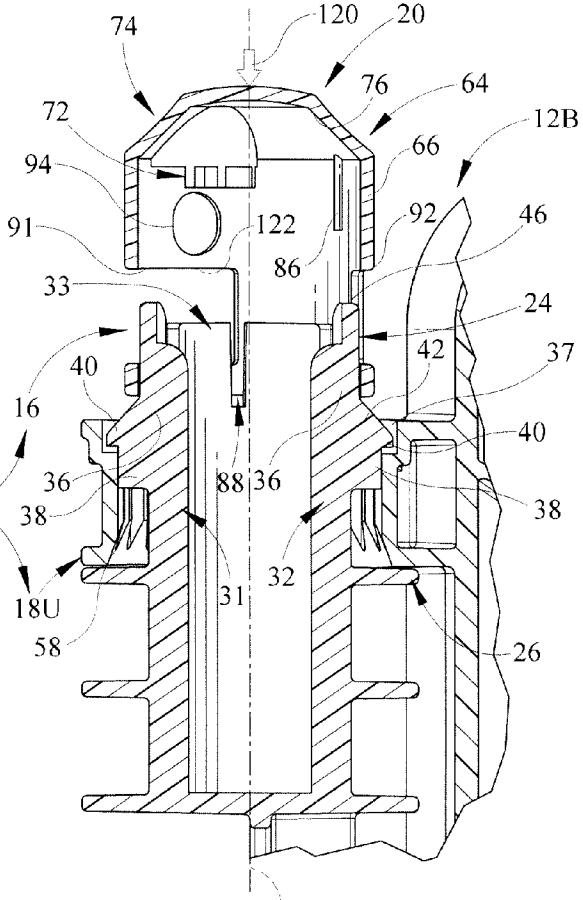
Figure 15:
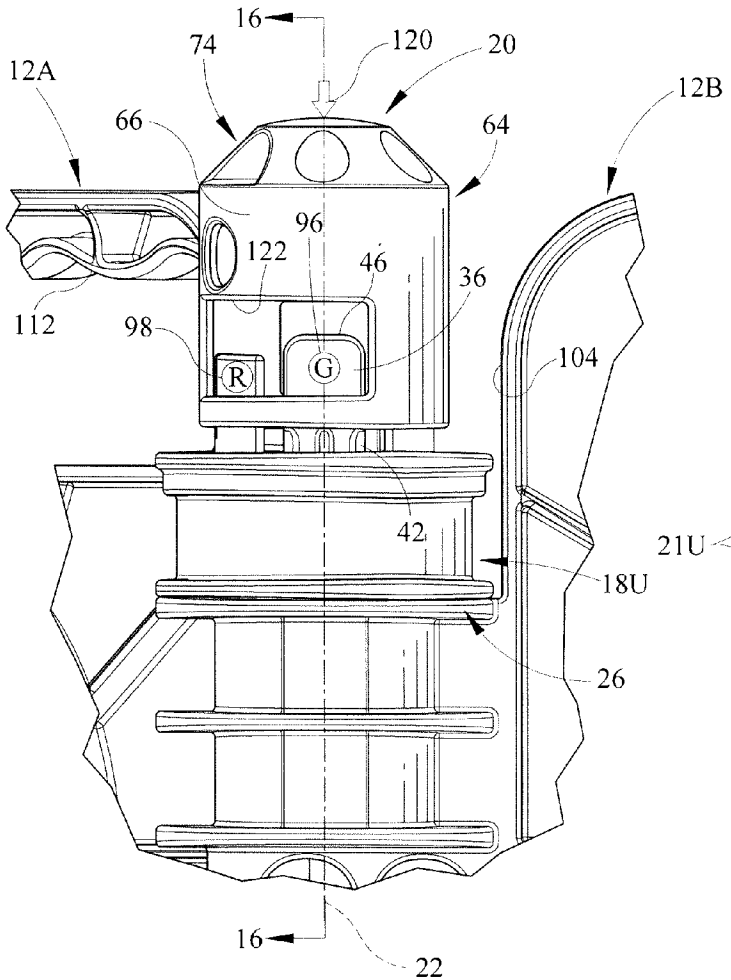
Figure 18:
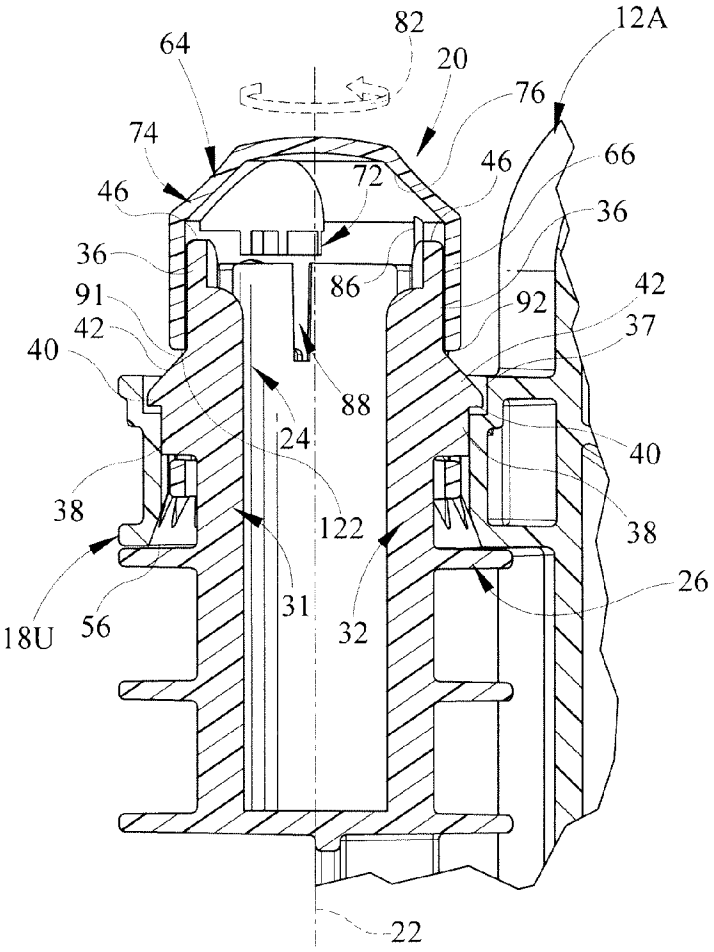

First and second ring retainers 31, 32 are deformable elastically in response to movement of upper ring 18U and locking cap 20 past ring retainers 31, 32 as shown in FIGS. 5, 6, 9, and 10 and suggested in FIGS. 15 and 16. During movement of upper ring 18U in a downward direction 120, first and second ring retainers 31, 32 deflect inwardly toward vertical pivot axis 22. After upper ring 18U is seated on and supported by post-support platform 26, ring retainers 31, 32 move outwardly away from vertical pivot axis 22 and return to the pre-deformation position thereby causing upper ring 18U to be retained in ring-retaining space 29 as shown in FIG. 4A.

Movable first ring retainer 31 is substantially the same as movable second ring retainer 32, and thus, only movable first ring retainer 31 will be discussed in detail. Movable first ring retainer 31 includes elastic deflectable retainer tab 36, ring-rotation blocker 38, ring-separation blocker 40, and tab-bender ramp 42 as shown in FIG. 4A. Retainer tab 36 is cantilevered to extend away from post-support platform 26 and configured to deform elastically inward toward vertical pivot axis 22. Ring-separation blocker 40 is appended to retainer tab 36 and arranged to extend outwardly away from retainer tab 36 and vertical pivot axis 22. Ring-rotation blocker 38 is appended to retainer tab 36 and arranged to extend outwardly away from retainer tab 36 and vertical pivot axis 22. Tab-bender ramp 42 is appended to retainer tab 36 and to ring-separation blocker 40. As illustrated in FIG. 4A, tab-bender ramp 42 slopes downwardly from retainer tab 36 toward ring-separation blocker 40.

Figure 22:
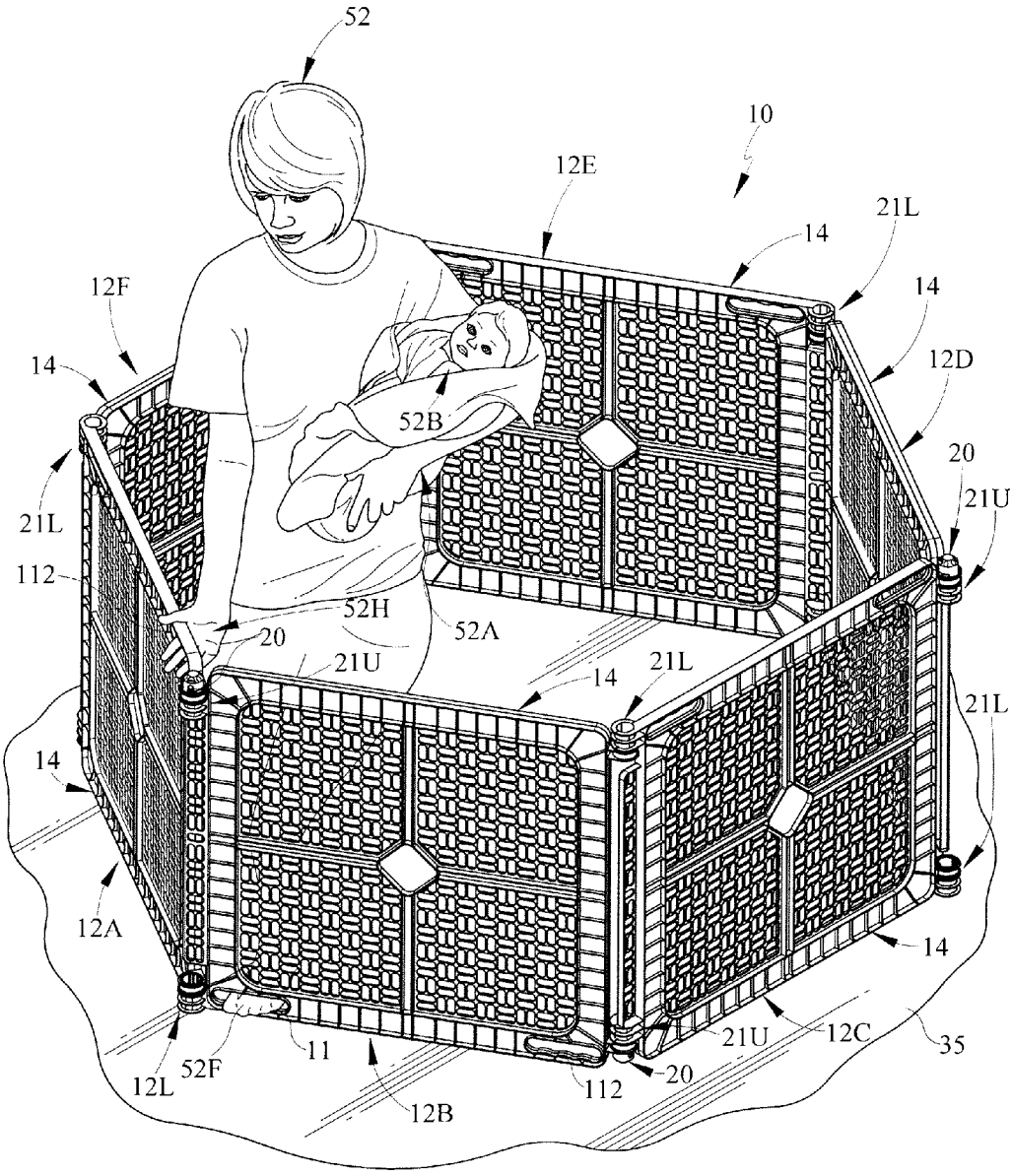
FIGS. 22-24 are a series of views showing an illustrative opening of the security enclosure by a caregiver.

Retainer tab 36, as shown in FIG. 4A, includes root end 44 and an opposite free end 46 spaced apart from root end 44. Root end 44 is coupled to post-support platform 26 to allow free end 46 to move inwardly toward vertical pivot axis 22 in response to movement of upper ring 18U past ring-separation blocker 40. Retainer tab 36 also includes inner surface 48 arranged to face toward vertical pivot axis 22 and opposite outer surface 50 arranged to face opposite inner surface 48 as shown in FIGS. 20 and 22.

Tab-bender ramp 42 is appended to outer surface 50 of retainer tab 36 between root end 44 and free end 46 of retainer tab 36. Tab-bender ramp 42 is arranged to slope downwardly away from retainer tab 36 to interconnect retainer tab 36 and ring-separation blocker 40. Tab-bender ramp 42 is configured to provide means for moving free end 46 of retainer tab 36 toward vertical pivot axis 22 in response to movement of upper ring 18U past ring-separation blocker 40. Tab-bender ramp 42 facilitates installation of upper ring 18U on ring mount 16 as suggested in FIGS. 5, 6, 9, and 10.

Ring-separation blocker 40 is coupled to outer surface 50 of retainer tab 36 between root end 44 and tab-bender ramp 42. Ring-separation blocker 40 is arranged to extend radially outward from retainer tab 36 and mate with an annular slot 37 formed in upper ring 18U after upper ring 18U has been installed on upper pivot post 24 as shown in FIG. 10. Ring-separation blocker 40 provides means for blocking upward movement of upper ring 18U after upper ring 18U has been seated against post-support platform 26.

Ring-rotation blocker 38 is appended to outer surface 50 and configured to mate with an interdental pocket 62 of upper ring 18U as suggested in FIG. 4A and shown in FIGS. 9 and 10. Ring-rotation blocker 38 is configured to provide means for blocking movement of upper ring 18U relative to upper pivot post 24U when locking cap 20 is in the locked position and configured to provide an audible sound and resistance to repositioning of first wall unit 12A relative second wall unit 12B when locking cap 20 is in the freed unlocked position.

Upper ring 18U is formed to include a first post-receiving aperture 56 and a post-receiving channel 61 and lower ring 18L is formed to include a second post-receiving aperture 58 and a post-receiving channel 61 as shown in FIG. 4. First and second post-receiving apertures 56, 58 are arranged to open into post-receiving channel 61 so that upper ring 18U is able to slide over companion pivot post 24 and lower ring 18L is able to slide over companion pivot post 24. Upper ring 18U is formed to include a series of interdental pockets 62 formed in circular inner wall 23 and arranged to open into post-receiving channel 61. As suggested in FIG. 4A and shown in FIGS. 10, 14, 16, and 18, each interdental pocket 62 is arranged to receive and mate with a companion ring-rotation blocker 38.

Locking cap 20 is used by a caregiver 52 to block pivoting movement of each wall unit relative to every other wall unit and to block separation of the wall units. As shown in FIGS. 13-18, locking cap 20 may be installed after upper ring 18U has mated with upper ring mount 16. Alternatively, locking cap 20 may be installed on upper ring mount 16 before upper ring 18U mates with upper ring mount 16. Locking cap 20 is rotated about vertical pivot axis 22 relative to upper ring mount 16 between the position shown in FIGS. 17-20 and the locked position shown in FIGS. 21 and 22. When locking cap 20 is in the unlocked position, first wall unit 12A and second wall unit 12B may be rotated about vertical pivot axis 22 relative to one another or separated from one another as suggested in FIGS. 23-25. When locking cap 20 is in the locked position, rotation of wall units 12A, 12B relative to one another is blocked and wall units 12A, 12B are blocked from separation from one another.

Locking cap 20 includes rotatable shell 64, a pair of tab stops 71, 72, and a pair of anti-drift lugs 85, 86 as shown diagrammatically in FIG. 4A and illustratively in FIGS. 20 and 22. Shell 64 is formed to include post-receiving space 68 and a post-receiving aperture 70 arranged to open into post-receiving space 68. Upper pivot post 24U is arranged to extend through post-receiving aperture 70 and into post-receiving space 68 when locking cap 20 slides over upper pivot post 24U as shown in FIGS. 13-18. First and second tab stops 71, 72 are appended to shell 64 and are arranged to extend into post-receiving space 68 toward post-support platform 26. First and second anti-drift lugs 85, 86 are appended to rotatable shell 64 and are arranged to extend toward upper pivot post 24U as shown in FIGS. 20 and 22.

Shell 64 includes a cylindrical shell wall 66 and a hand grip 74 which is coupled to cylindrical shell wall 66 opposite post-receiving aperture 70. Cylindrical shell wall 66 and hand grip 74 cooperate to define post-receiving space 68. Hand grip 74 is configured to provide means for gripping locking cap 20 by a hand 52H of caregiver 52 so that locking cap 20 may be rotated about vertical pivot axis 22 in one of a ring-locking direction (counter-clockwise) 82 and a ring-unlocking direction (clockwise) 81 as suggested in FIG. 4A.

First tab stop 71 is substantially the same as second tab stop 72, and thus, only first tab stop 71 will be discussed in detail. First tab stop 71 is appended to an inner surface 76 of hand grip 74 and arranged to extend downwardly into post-receiving space 68. First tab stop 71 is positioned to lie in spaced-apart relation to cylindrical shell wall 66 between cylindrical shell wall 66 and vertical pivot axis 22. First tab stop 71 defines a first ring-retainer space 78 which is configured to receive first ring retainer 31 therein as shown in FIG. 4A. Second tab stop 72 defines a second ring-retainer space 80 which is configured to receive second ring retainer 32 therein. When locking cap 20 is in the locked position, free end 46 of retainer tab 36 included in first ring retainer 31 is trapped between cylindrical shell wall 66 and first tab stop 71. At the same instance, free end 46 of retainer tab 36 of second ring retainer 32 is trapped between cylindrical shell wall 66 and second tab stop 72. As a result, radially inward deflection of ring retainers 31, 32 is blocked and separation and rotation of first and second wall units 12A, 12B relative to another is blocked.

In use, caregiver 52 desiring to block separation of first and second wall units 12A, 12B, rotates locking cap 20 in a first ring-locking direction 81 through an acute angle 65 to cause locking cap 20 to assume the locked position shown in FIGS. 21, 22. As a result, first tab stop 71 moves from about an eight o'clock position to a six o'clock position and second tab stop 72 moves from about a two o'clock position to a twelve o'clock position. When tab stops 71, 72 are at the six o'clock and twelve o'clock positions respectively, radially inward movement of ring retainers 31, 32 is blocked as shown in FIGS. 4A and 20.

During rotation of locking cap 20 from the unlocked position to the locked position, anti-drift lugs 85, 86 move from first positions to second positions. Anti-drift lugs 85, 86 cooperate to provide means for minimizing drift of locking cap 20 during use of security enclosure 10. The first position of first anti-drift lug 85 is located adjacent a first gap 83 formed between first ring retainer 31 and outer stationary flange 34. The second position of first anti-drift lug 85 is in a first lug-receiving slot 87 formed in outer stationary flange 34. The first position of second anti-drift lug 86 is located adjacent a second gap 84 formed between second ring retainer 32 and inner stationary flange 33 as shown in FIG. 20. The second position of second anti-drift lug 86 is in a second lug-receiving slot 88 formed in inner stationary flange 33 as shown in FIG. 22.

Figure 14:
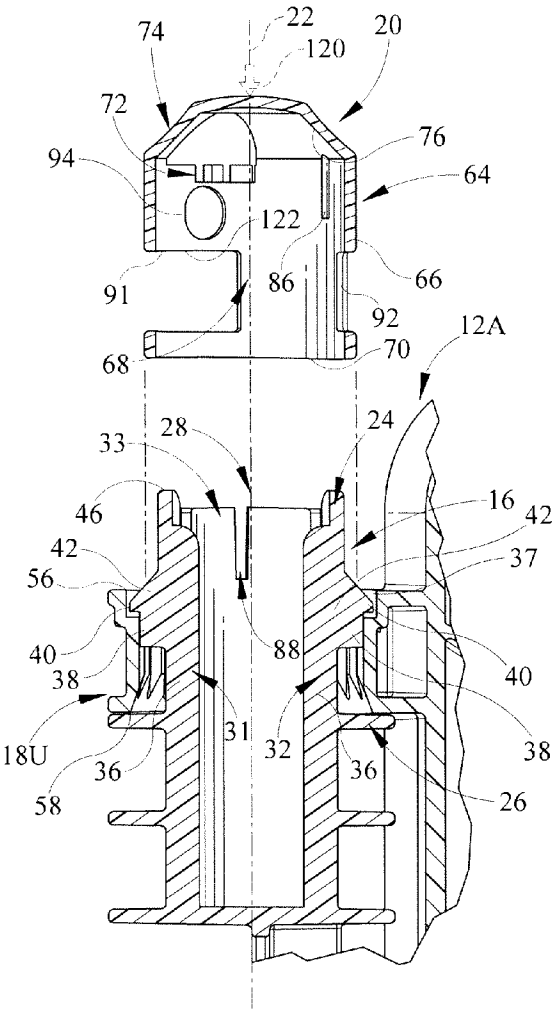
FIGS. 13-18 are a series of views showing installation of the lock cap on the upper ring and ring mount so that the upper pivot joint may be locked as suggested in FIGS. 17, 19, 20, and 21.
Figure 13:
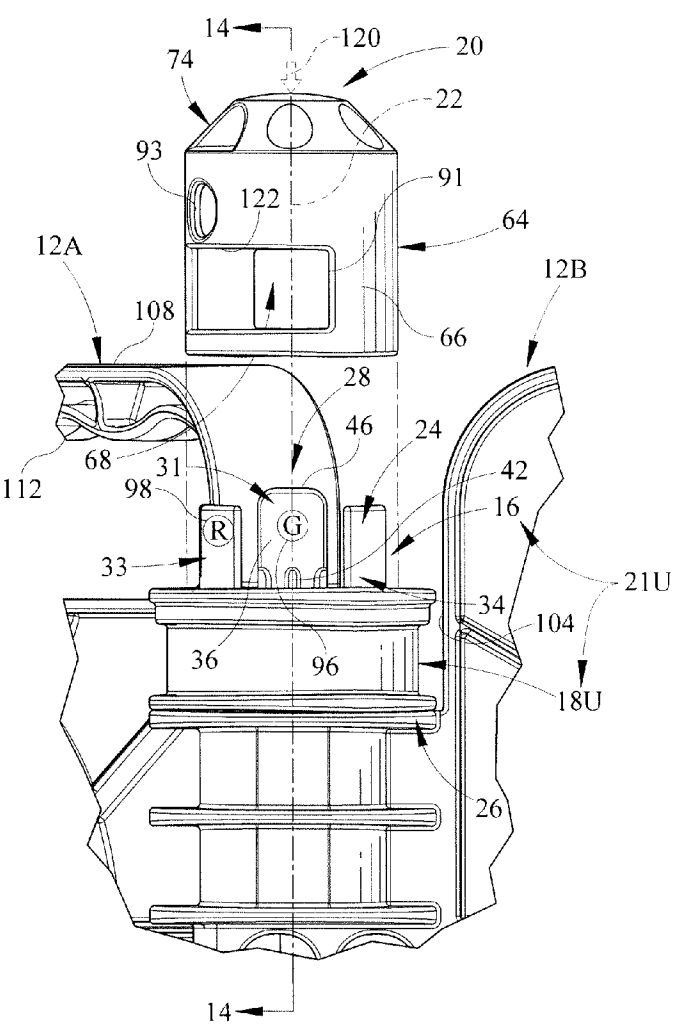

Locking cap 20 is further formed to include a pair of ring-separation blocker slots 91, 92 and a pair of status-indicator apertures 93, 94 as shown, for example, in FIGS. 13 and 14. Ring-separation blocker slots 91, 92 are arranged to open into post-receiving channel 61 so that each ring-separation blocker 40 may extend from retainer tab 36 in post-receiving channel 61 through ring-separation blocker slots 91, 92 and engage and retain ring 18 as shown in FIGS. 10, 14, 16, 18, 20, and 22. Status-indicator apertures 93, 94 are arranged to open into post-receiving channel 61 so that a color applied a top portion of each ring retainer 31, 32 and a portion of inner and outer stationary flanges 33, 34 may be seen by caregiver 52 through status-indicator apertures 93, 94. As an example, a red color 98 applied to stationary flanges 33, 34 may be seen through status-indicator apertures 93, 94 when locking cap 20 is in the unlocked position and a green color 96 applied to elastic deformable retainer tabs 36, 32 may be seen through status-indicator apertures 93, 94 when locking cap 20 is in the locked position.

Panel 14 includes a web 100 and a perimeter 102 as shown in FIG. 2. Perimeter 102 is arranged to extend around web 100. Perimeter 102 includes a post side 104, an opposite ring side 106, a first horizontal side 108 extending between and interconnecting post and ring sides 104, 106, and a second horizontal side 110 opposite top side 108 and arranged to interconnect post and ring sides 104, 106. As shown in FIGS. 2 and 3, male-edge connector 13 is coupled to panel 14 along post side 104 and female-edge connector 15 is coupled to panel 14 along ring side 106. Perimeter 102 is formed to include a pair of grip apertures 111, 112 positioned to lie in spaced-apart relation to one another adjacent to first horizontal side 108 as shown in FIG. 2.

Figure 30:
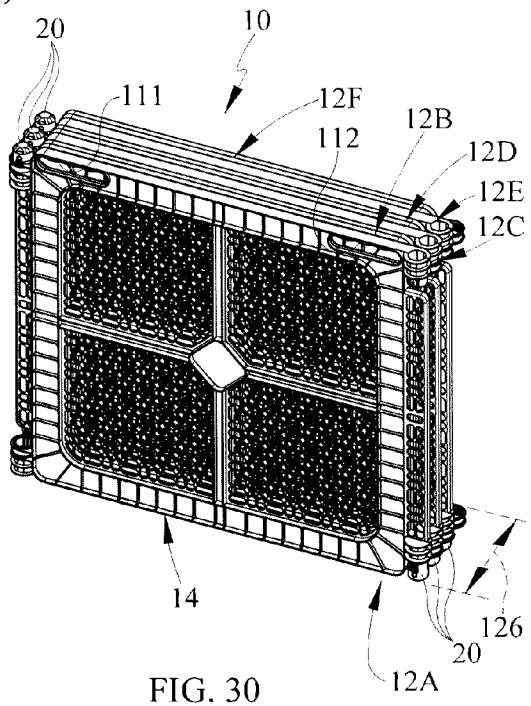
FIG. 30 is a perspective view of the security enclosure of FIGS. 1, 25, and 29 showing the security enclosure may be arranged to assume a folded-storage position.

As shown in FIGS. 2 and 3, first horizontal side 108 of first wall unit 12A is arranged to lie in spaced-apart relation to ground 35 to cause second horizontal side 110 to be located therebetween. Also shown in FIGS. 2 and 3, first horizontal side 108 of second wall unit 12B is arranged to lie in between ground 35 and second horizontal side 110. Alternating orientations of first horizontal side 108 may be used so that security enclosure 10 has a minimized thickness when arranged in the folded-storage position as shown in FIG. 30.

In an example of use, caregiver 52 starts by rotating locking cap 20 about vertical pivot axis 22 in either ring-locking direction 82 or ring-unlocking direction 81. As shown in FIG. 22, caregiver 52 holds a baby 52B in her left arm 52A and attempts to exit security enclosure 10. As a result, caregiver 52 rotates locking cap 20 in ring-unlocking direction 81 to cause locking cap 20 to assume the unlocked position. Caregiver 52 then inserts caregiver's left foot 52F into grip aperture 111 of second wall unit 12B and inserts caregiver's right hand 52H into grip aperture 112 of first wall unit 12A as shown in FIG. 22. Next, caregiver applies an upward force F to panel 14 of first wall unit 12A to separate first wall unit 12A from second wall unit 12B as shown in FIGS. 23 and 24. After first and second wall units 12A, 12B are separated, caregiver 52 may separate wall units 12A, 12B to establish a gap 114 therebetween that permits caregiver 52 to exit security enclosure 10.

As another example of use, caregiver 52 again starts by moving locking cap 20 to the unlocked position. Caregiver 52 then uses left arm 52A to push locking cap 20 in downward direction 120 to cause retainer tabs 36 to deflect inwardly toward one another in response to an upper edge 122 of ring-separation blocker slots 91, 92 engaging tab-bender ramp 42 and then inserts left foot 52F into grip aperture 111 of second wall unit 12B and inserts right hand 52H into grip aperture 112 of first wall unit 12A. Using locking cap 20 as suggested herein minimizes the amount of force F required to deform elastic deformable retainer tabs 36. Finally, caregiver applies upward force F to panel 14 of first wall unit 12A to separate first wall unit 12A from second wall unit 12B.

Figure 25:
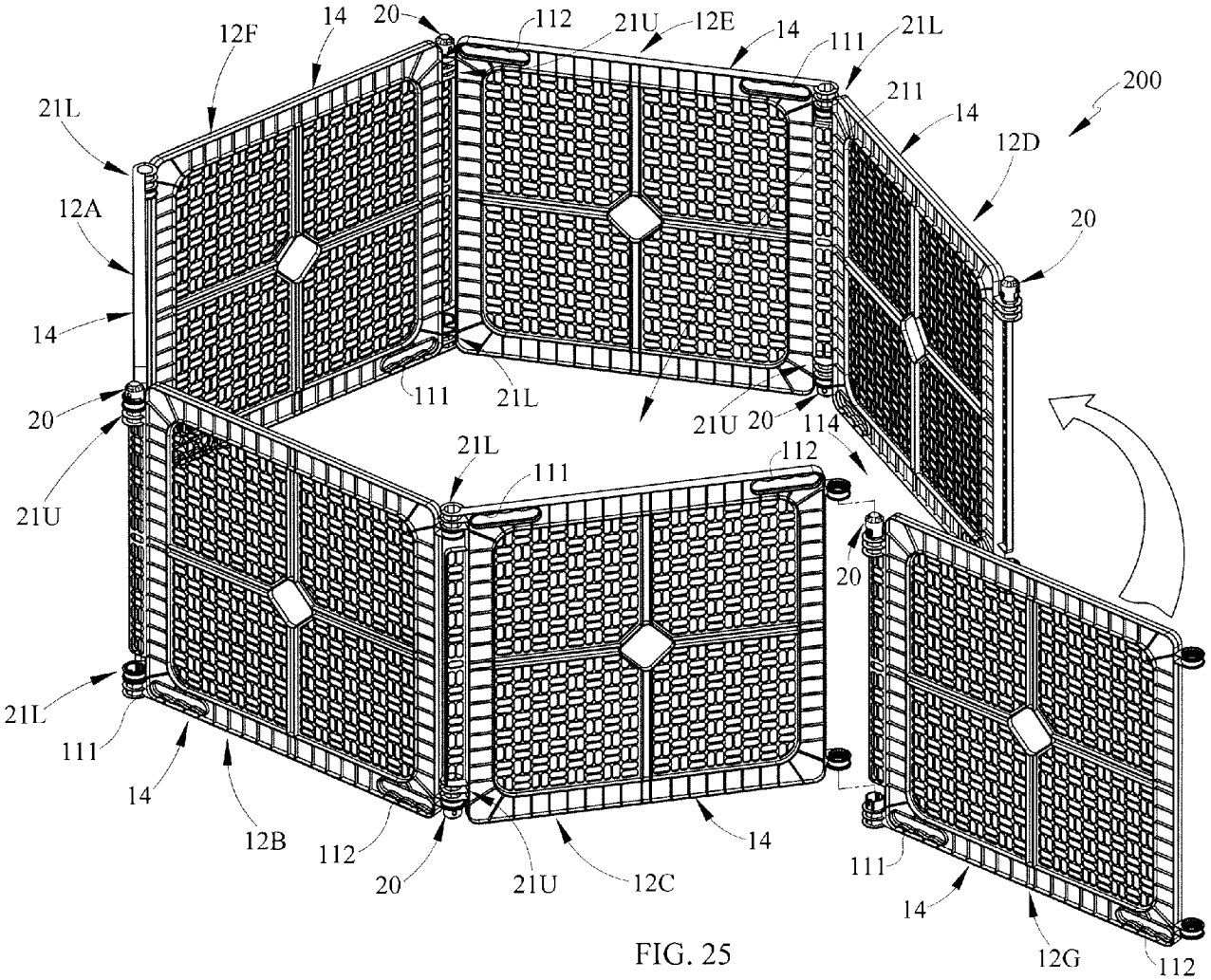
FIG. 25 is a perspective view of the security enclosure of FIG. 1 showing that the security enclosure may be enlarged by separating the left and right wall units to establish a gap therebetween and then inserting a new wall unit in the gap and coupling the new wall unit to the right and left wall units to cause the security enclosure to have a heptagon shape as suggested in FIG. 26.
Figure 26:
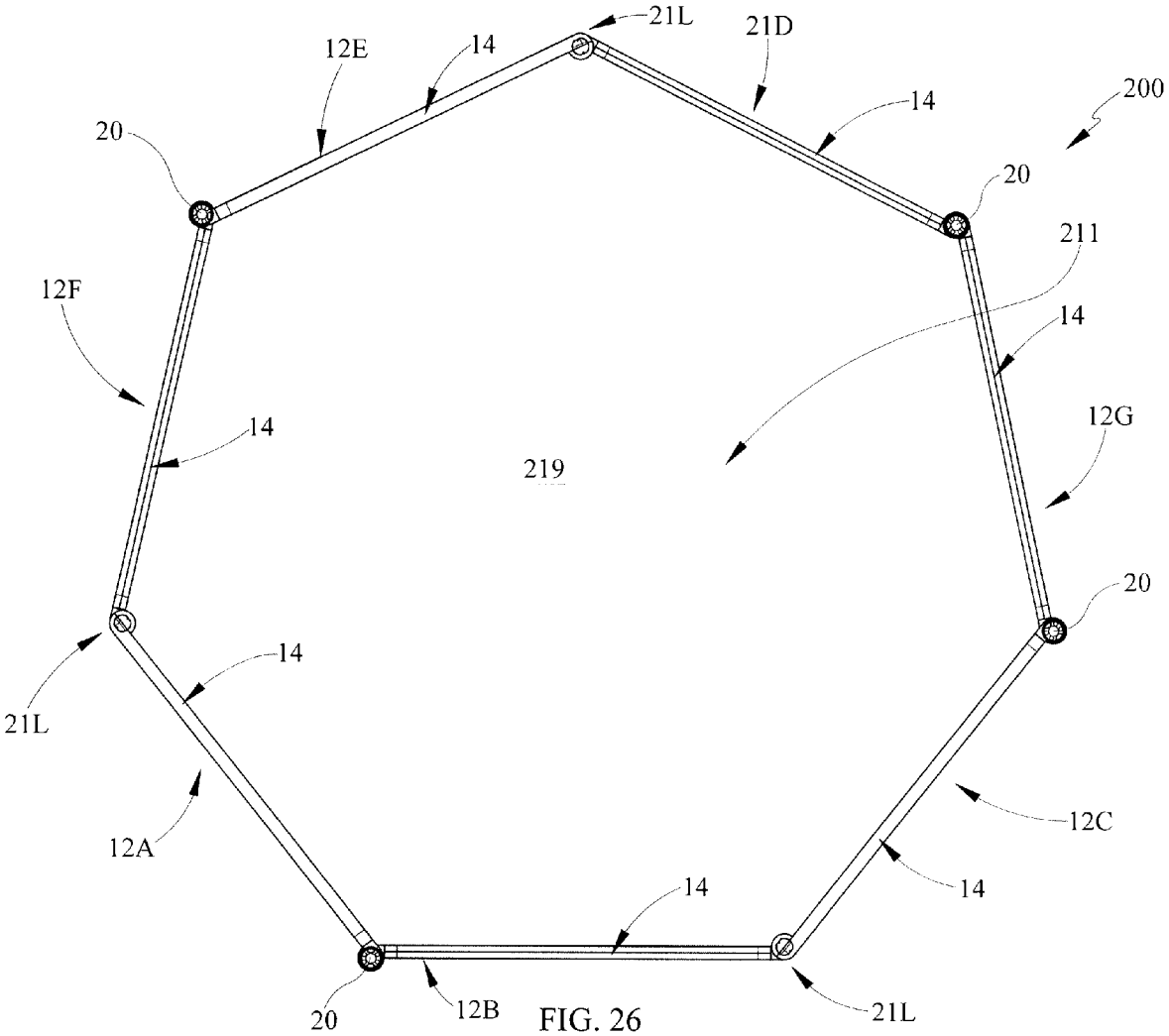
FIG. 26 is top plan view of a security enclosure including seven sides and arranged to have a heptagon shape.

Security enclosure 10 may be modified by adding wall units 12 as suggested in FIGS. 25 and 26. In a first example, third and fourth wall units 12C, 12D have been separated and gap 114 is established therebetween as shown in FIG. 25. A seventh wall unit 12G is then coupled to third and fourth wall units 12C, 12D to establish a security enclosure 200. Security enclosure 200 has a relatively larger closed space 211 that is defined between wall units 12A, 12B, 12C, 12D, 12E, 12F, and 12G. Security enclosure 200 also has a heptagon shape. While only one wall unit 12 has been shown added, any number of wall units may be added within the scope of the present disclosure.

Figure 27:
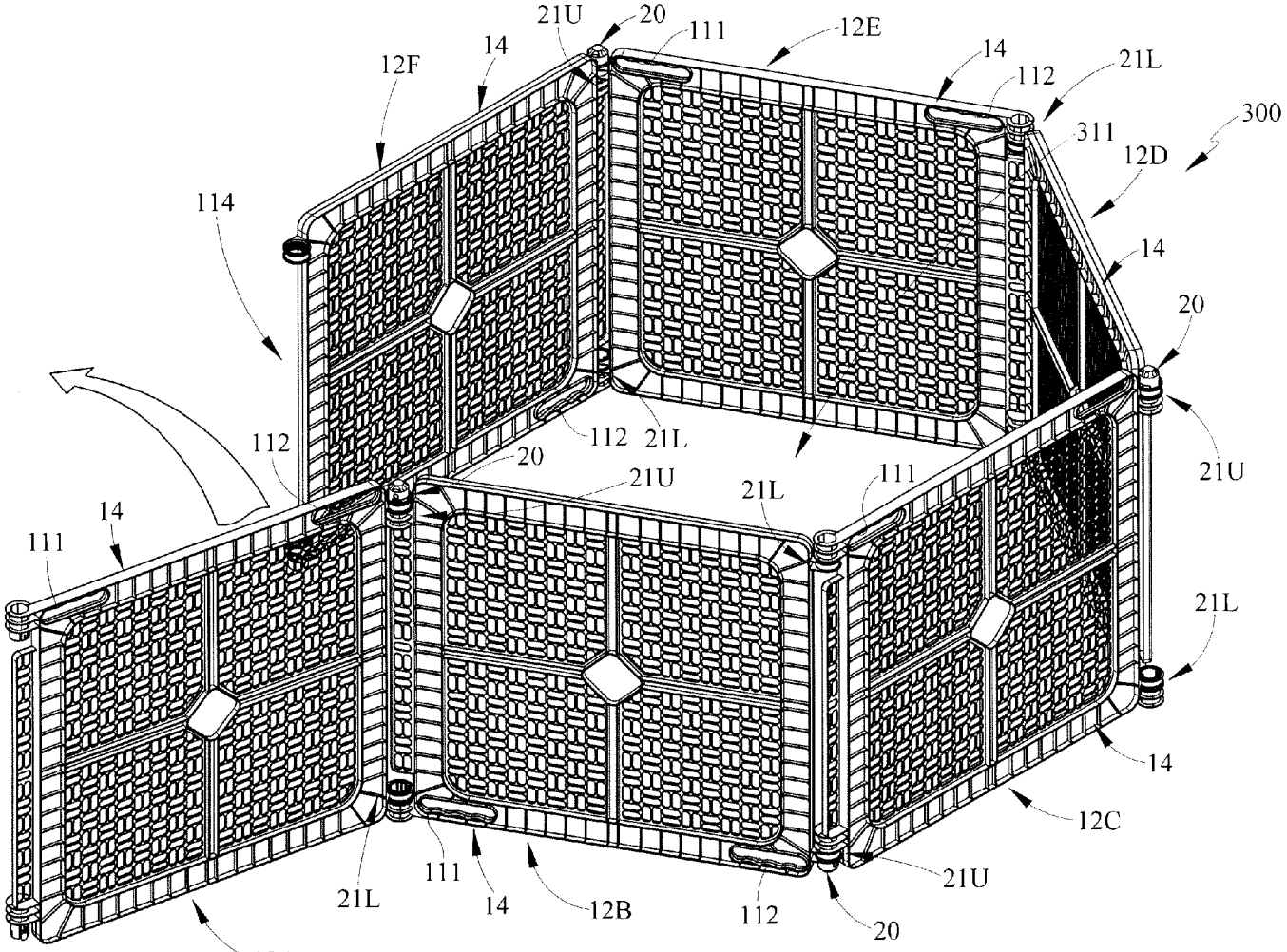
FIG. 27 is a perspective view of the security enclosure of FIGS. 1 and 25 showing that the security enclosure may be shrunk by separating the sixth wall unit from the fifth and first wall units to establish a gap and then coupling the first wall unit to the fifth wall unit to cause the security enclosure to have a pentagon shape as suggested in FIG. 28.
Figure 28:
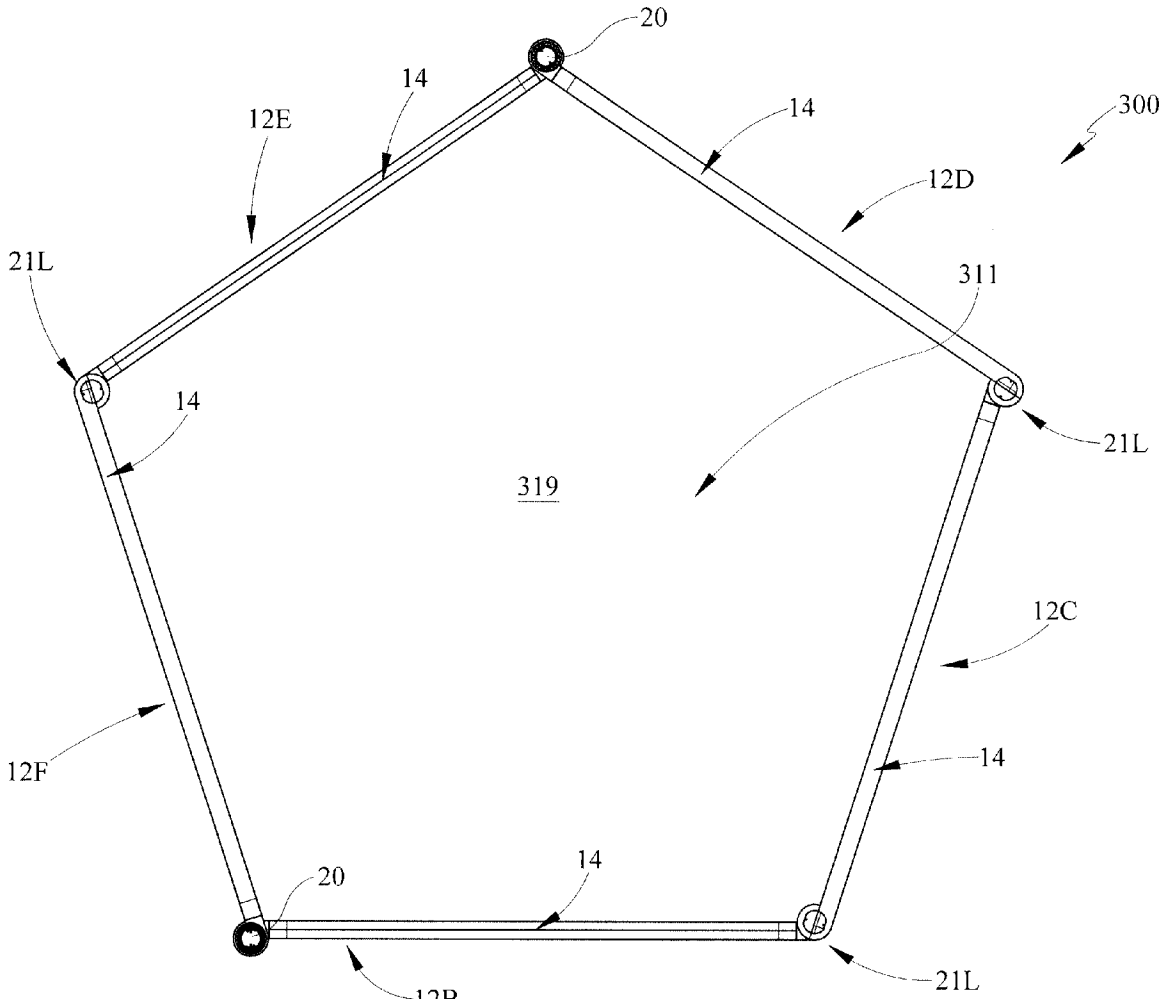
FIG. 28 is a top plan view of a security enclosure including five sides and arranged to have a pentagon shape.

Security enclosure 10 may be further modified by subtracting wall units 12 as suggested in FIGS. 27 and 28. In another example, first and sixth wall units 12A, 12F have been separated and gap 114 established therebetween as shown in FIG. 27. First wall unit 12A is then separated from sixth wall unit 12F. Finally, sixth wall unit 12F is then coupled to second wall unit 12B to establish a security enclosure 300. Security enclosure 300 has a relatively smaller closed space 311 that is defined by wall units 12A, 12B, 12C, 12D, and 12E as shown in FIG. 28. As a result, security enclosure 300 has a pentagon shape. While only one wall unit has been shown removed, additional wall units may yet be removed.

Figure 29:
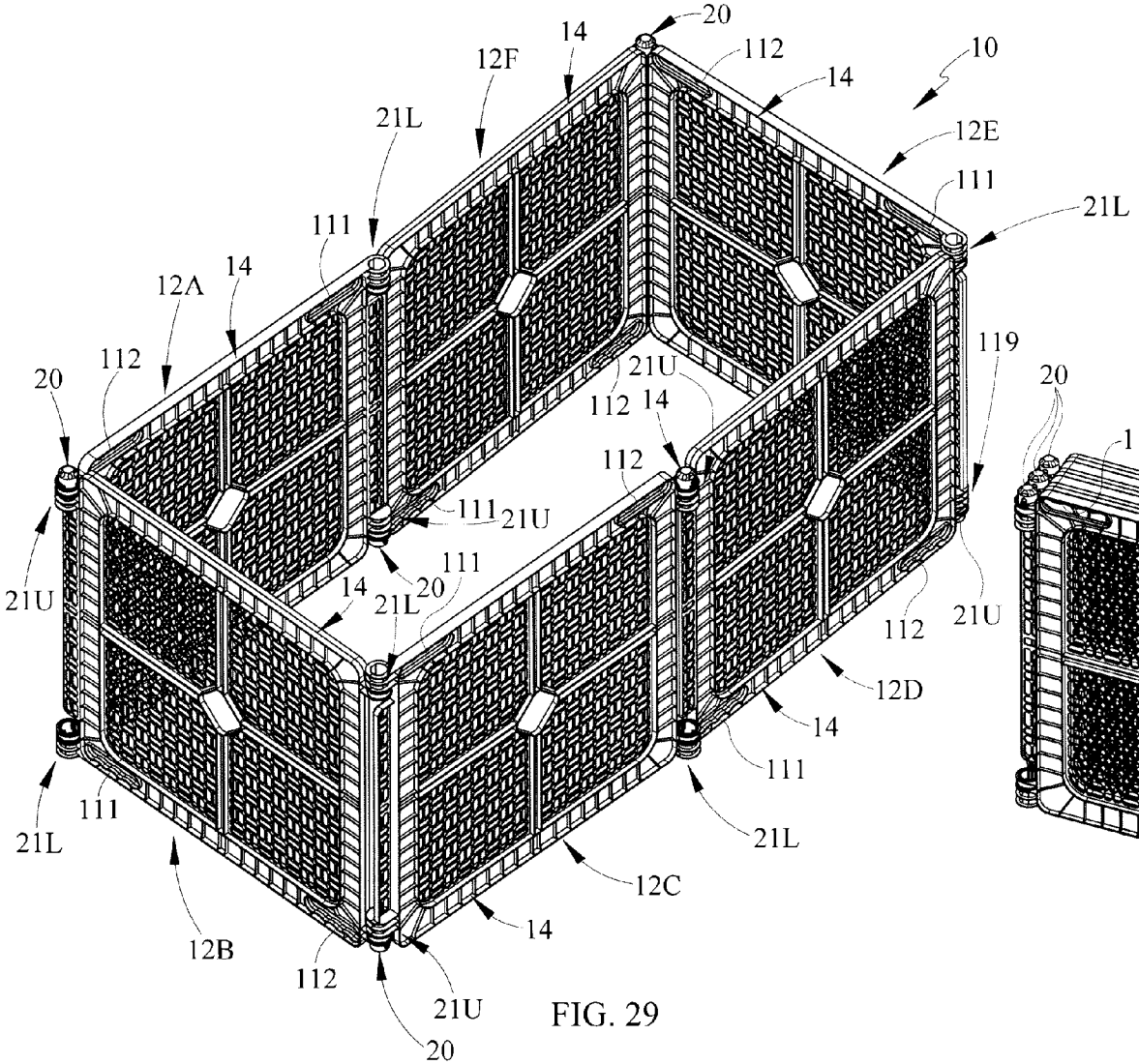
FIG. 29 is a perspective view of the security enclosure of FIGS. 1 and 25 showing that the security enclosure having six wall units may be reconfigured to have a rectangular shape.

Security enclosure 10 may yet still be modified further by re-arranging wall units 12A, 12B, 12C, 12D, 12E, and 12F from the hexagon shape of FIG. 1 to a rectangle shape as shown in FIG. 29. Security enclosure 10 may be modified even further by arranging wall units 12A, 12B, 12C, 12D, 12E, and 12F into folded shape as shown in FIG. 29. Folded shape of security enclosure 10 resembles a compressed accordion and minimizes a foot print 119 of security enclosure 10. Caregiver 52 achieves the folded shape by rotating each wall unit so that the wall unit faces and lies in confronting relation with at least one other wall unit to assume a first folded width 126. Caregiver 52 may re-establish the hexagon shape by unfolding security enclosure 10 and arranging the panels so that included angle 60 is established between each pair of adjacent wall units.

Figure 31:
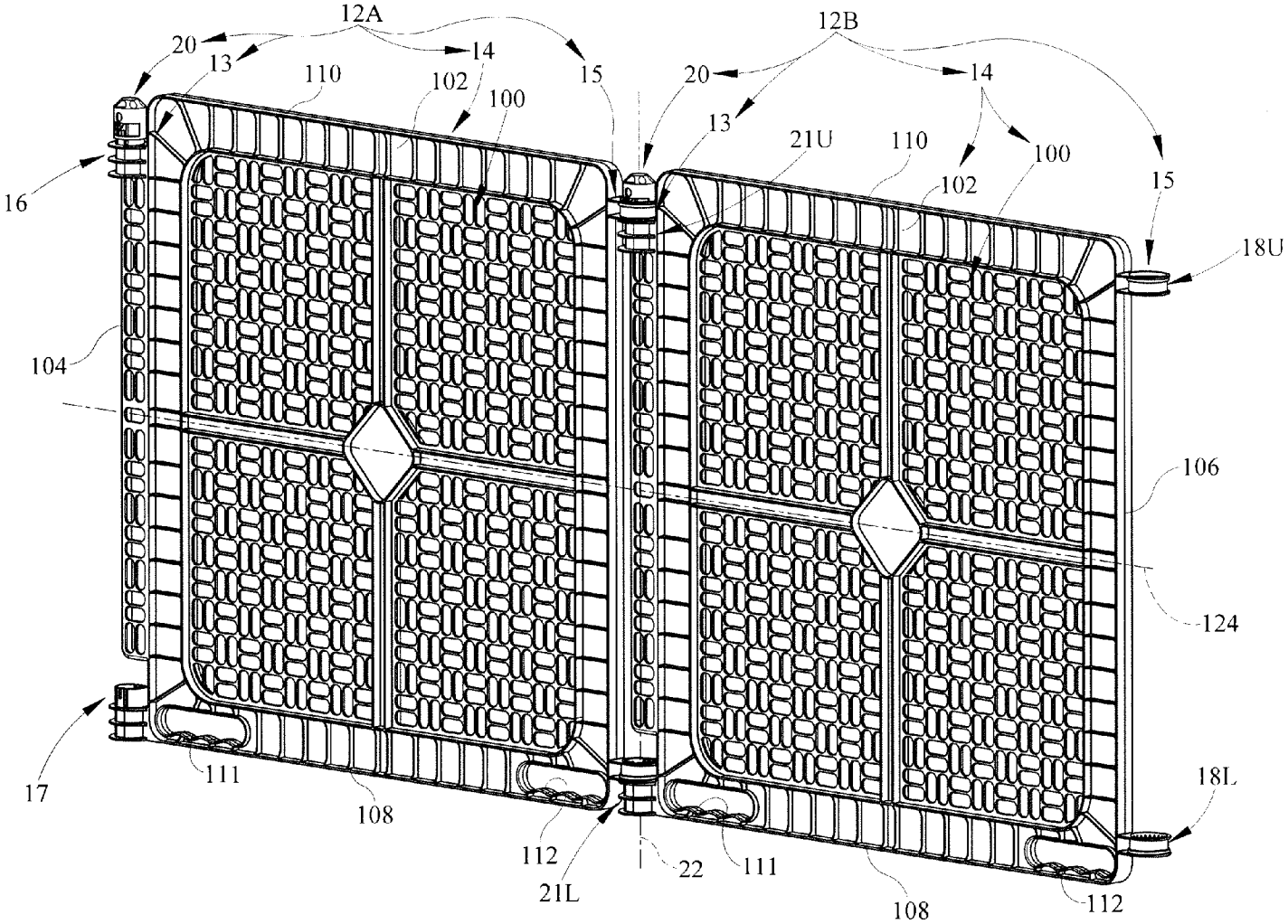
FIG. 31 is a perspective view of another arrangement of right and left wall units coupled together showing that the left wall unit may be coupled to the right wall unit after the left wall unit has been flipped 180 degrees so that the grip apertures of the left wall unit are arranged to lie along the ground like the grip apertures of the right wall unit.

Security enclosure 10 may be further modified by flipping first wall unit 12A about a horizontal axis 124 and coupling first wall unit 12A to second wall unit 12B as shown in FIG. 31. First wall unit 12A may be rotated about 180 degrees about horizontal axis 124 relative to second wall unit 12B so that first and second grip apertures 111, 112 included in second wall unit 12A are arranged to lie adjacent ground 35 as illustrated in FIG. 31. Locking cap 20 of first wall unit 12A is shown coupled to upper pivot post 24 included in first wall unit 12A while upper and lower pivot joints 21L, 21U are formed with adjacent second wall unit 12B as shown in FIG. 31. When security enclosure 10, as modified in FIG. 31, is arranged to assume a folded shape similar to FIG. 30, the security enclosure then has a relatively larger second folded width as a result of interference with locking caps 20 being arranged to lie adjacent to one another rather than alternating as shown in FIG. 2.

Upper ring 18U and companion upper ring mount 16 cooperate to establish upper pivot joint 21U as shown in FIGS. 2, 4, and 32. Upper pivot joint 21U is established without the use of hardware, such as screws, bolts, nuts, springs, etc. and may be formed of various materials such as plastics materials, metal, or wood. Locking cap 20 is coupled to upper pivot joint 21U to block separation and rotation of two neighboring wall units. Caregiver 52 may rotate locking cap 20 less than 90 degrees using only one hand 52H and then separate wall units 12A, 12B using only one hand.

Each wall unit 12 is identical to every other wall unit 12 permitting caregiver 52 to use at least four wall units 12 to establish various shapes and sizes of the security enclosure. Caregiver 52 may arrange wall units 12 in back-to-back confronting relation to one another as shown in FIG. 30 for storage or transportation of the security enclosure.

The invention claimed is:

1. A multi-sided security enclosure comprising:

several wall units adapted to be connected to one another in series to form a closed space, each wall unit including:

a female-edge connector including spaced-apart upper and lower rings, each of the upper and lower rings being formed to include a post-receiving channel, a male-edge connector arranged to lie in spaced-apart relation to the female-edge connector and including spaced-apart upper and lower ring mounts, each upper ring mount being associated with the upper ring in the female-edge connector of a neighboring wall unit, each lower ring mount being associated with the lower ring in the female-edge connector of the neighboring wall unit, and a panel arranged to extend between companion male- and female-edge connectors in a single wall unit and adapted to contact ground underlying the panel when a multi-sided security enclosure comprising the several wall units is erected, wherein each upper ring mount includes an upper pivot post formed on a top side of a post-support platform extending from a side of the male-edge connector, where the upper pivot post is arranged to extend into a post-receiving channel formed in the upper ring of a neighboring second of the several wall units to establish a pivot joint between the first and second of the several wall units so that the second of the several wall units is free to rotate about a vertical pivot axis relative to the first of the several wall units to vary the included angle therebetween at the option of a caregiver during assembly of the multi-sided security enclosure, wherein the upper pivot post includes a radially deflectable first ring retainer extending upwardly through the post-receiving channel formed in the upper ring of the neighboring second of the several wall units, the first ring retainer including a ring-separation blocker extending outwardly therefrom at a point above the upper ring such that:

when the first ring retainer is in a deflected, upright position, the ring-separation blocker prevents upward movement of the upper ring relative to the upper ring mount, and when the first ring retainer is deflected inwardly to a deflected position, the upper ring is upwardly removable from the upper ring mount, and wherein the first of the wall units further includes a locking cap configured for rotating on an exposed free tip of the upper pivot post about the vertical pivot axis, the locking cap comprising a shell surrounding the upper pivot post, and having a first tab stop coupled to an inner surface thereof and extending into the post receiving channel of the upper ring, wherein the locking cap is rotatable between:

a locked position wherein the first tab stop is positioned to block radially inward movement of the first ring retainer from the upright position to the deflected position; and an unlocked position wherein the first tab stop is rotated about the vertical pivot axis away from the first ring retainer, thereby freeing the first ring retainer to move from the upright position toward the vertical pivot axis to the deflected position during separating movement of the first of the several wall units relative to the second of the wall units to facilitate separation of the upper ring mount from the upper pivot post leading to separation of the first of the several wall units from the second of the several wall units.

2. The enclosure of claim 1, wherein the upper pivot post included in the upper ring mount of the first of the several wall units further includes a stationary flange, each of the first ring retainer and the stationary flange is coupled to a top side of the post-support platform and arranged to extend upwardly through the post-receiving channel formed in the upper ring of the neighboring second of the several wall units, and the movable first ring retainer includes an elastic deflectable retainer tab coupled to the top side of the post-support platform and arranged to extend upwardly along and in spaced-apart relation to each of the stationary flange and the vertical pivot axis, wherein the ring-separation blocker is appended to the elastic deflectable retainer tab and arranged to extend outwardly away from the elastic deflectable retainer tab and the vertical pivot axis to lie in spaced-apart relation to the top side of the post-support platform to define a ring-retaining space therebetween receiving the upper ring therein when the locking cap is in the locked position, and a tab-bender ramp appended to the elastic deflectable retainer tab to locate the ring-separation blocker between the post-support platform and the tab-bender ramp and configured to provide means for moving a free end of the elastic deflectable retainer tab inwardly toward the vertical pivot axis in response to movement of the upper ring downwardly toward the post-support platform and past the ring-separation blocker to reach the ring-receiving space and to establish the pivot joint between the first of the several wall units and the neighboring second of the several wall units.

3. The enclosure of claim 2, wherein the elastic deflectable retainer tab includes a root end and an opposite free end spaced apart from the root end and the root end is coupled to the post-support platform to allow the opposite free end to move inwardly toward the vertical pivot axis in response to movement of the upper ring of the neighboring second of the several units downwardly toward the post-support platform and past the ring-separation blocker.

4. The enclosure of claim 3, wherein the elastic deflectable retainer tab includes an inner surface arranged to face toward the vertical pivot axis and an opposite outer surface arranged to face away from the vertical pivot axis and the tab-bender ramp is appended to the outer surface.

5. The enclosure of claim 4, wherein the tab-bender ramp and a portion of the elastic deflectable tab arranged to lie above the tab-bender ramp and in spaced-apart relation to the post-support platform cooperate to define an obtuse included angle therebetween.

6. The enclosure of claim 3, wherein the ring-separation blocker is arranged to lie between the tab-bender ramp and the root end of the elastic deflectable retainer tab.

7. The enclosure of claim 6, wherein the elastic deflectable retainer tab includes an inner surface arranged to face toward the vertical pivot axis and an opposite outer surface arranged to face away from the vertical pivot axis and the tab-bender ramp is appended to the outer surface and the movable first ring retainer further includes a ring-rotation blocker that is appended to the outer surface of the elastic deflectable retainer tab and is configured to provide means for extending into a pocket formed in the upper ring of the neighboring second of the several wall units to block movement of the upper ring relative to the upper pivot post of the first of the several wall units when the locking cap is in the locked position.

8. The enclosure of claim 7, wherein the ring-rotation blocker is configured to provide means for providing an audible sound and resistance to repositioning of the first of the several wall units relative to the second of the several wall units when the locking cap is moved to assume the unlocked position.

9. The enclosure of claim 6, wherein the upper ring of the second of the several wall units is formed to include a series of interdental pockets arranged to open into the post-receiving channel and to receive and mate with the ring-rotation blocker.

10. The enclosure of claim 2, wherein the tab-bender ramp is arranged to slope downwardly away from the elastic deflectable retainer tab to interconnect the elastic deflectable retainer tab and the ring-separation blocker.

11. The enclosure of claim 10, wherein the elastic deflectable retainer tab includes an inner surface arranged to face toward the vertical pivot axis and an opposite outer surface arranged to face away from the vertical pivot axis and the tab-bender ramp is appended to the outer surface and the movable first ring retainer further includes a ring-rotation blocker that is appended to the outer surface of the elastic deflectable retainer tab and is configured to provide means for extending into a pocket formed in the upper ring of the neighboring second of the several wall units to block movement of the upper ring relative to the upper pivot post of the first of the several wall units when the locking cap is in the locked position.

12. The enclosure of claim 2, wherein the movable first ring retainer further includes a ring rotation blocker that is configured to provide means for extending into a pocket formed in the upper ring of the neighboring second of the several wall units to block movement of the upper ring relative to the upper pivot post of the first of the several wall units when the locking cap is in the locked position.

13. The enclosure of claim 12, wherein the ring-rotation blocker is configured to provide means for providing an audible sound and resistance to repositioning of the first of the several wall units relative to the second of the several wall units when the locking cap is moved to assume the unlocked position.

14. A multi-sided security enclosure comprising:

several wall units adapted to be connected to one another in series to form a closed space, each wall unit including a female-edge connector including spaced-apart upper and lower rings, each of the upper and lower rings being formed to include a post-receiving channel, a male-edge connector arranged to lie in spaced-apart relation to the female-edge connector and including spaced-apart upper and lower ring mounts, each upper ring mount being associated with the upper ring in the female-edge connector of a neighboring wall unit, each lower ring mount being associated with the lower ring in the female-edge connector of the neighboring wall unit, and a panel arranged to extend between companion male- and female-edge connectors in a single wall unit and adapted to contact ground underlying the panel when a multi-sided security enclosure comprising the several wall units is erected, wherein an upper pivot post included in the upper ring mount of a first of the several wall units is arranged to extend into a post-receiving channel formed in the upper ring of a neighboring second of the several wall units to establish a pivot joint between the first and second of the several wall units so that the second of the several wall units is free to rotate about a vertical pivot axis relative to the first of the several wall units to vary the included angle therebetween at the option of a caregiver during assembly of the multi-sided security enclosure, wherein the upper pivot post included in the upper ring mount of the first of the several wall units includes a movable first ring retainer extending upwardly through the post-receiving channel formed in the upper ring of the neighboring second of the several wall units to a point above the upper ring surrounding the upper pivot post, and wherein the first of the wall units further includes a locking cap configured to provide means for rotating on an exposed free tip of the upper pivot post arranged to lie above the upper ring surrounding the upper pivot post at the option of an operator in one of a first ring-locking direction to assume a locked position arranged to block inward movement of the movable first ring retainer from an upright position blocking withdrawal of the upper pivot post from the post-receiving channel formed in the upper ring toward the vertical pivot axis to a deformed position allowing withdrawal of the upper pivot post from the post-receiving channel formed in the upper ring to facilitate separation of the first and second of the several wall units during disassembly of the multi-sided security enclosure and an opposite second ring-unlocking direction to assume an unlocked position freeing the movable first ring retainer to move from the upright position toward the vertical pivot axis to the deformed position during separating movement of the first of the several wall units relative to the second of the wall units to facilitate separation of the upper ring mount from the upper pivot post leading to separation of the first of the several wall units from the second of the several wall units, wherein the upper ring mount included in the male-edge connector of the first of the several wall units further includes a post-support platform arranged to extend away from a post side of the panel that is coupled to the male-edge connector of the first of the several wall units, the upper pivot post is coupled to the post-support platform and arranged to extend upwardly along the vertical pivot axis away from the ground underlying the panel of the first of the several wall units and lie in spaced-apart relation to the post side of the panel of the first of the several wall units, and the upper ring of the neighboring second of the several wall units is arranged to lie between the post-support platform and the exposed free tip of the upper pivot post, wherein the upper pivot post included in the upper ring mount of the first of the several wall units further includes a stationary flange, each of the movable first ring retainer and the stationary flange is coupled a top side of the post-support platform and arranged to extend upwardly through the post-receiving channel formed in the upper ring of the neighboring second of the several wall units, and the movable first ring retainer includes an elastic deflectable retainer tab coupled to the top side of the post-support platform and arranged to extend upwardly along and in spaced-apart relation to each of the stationary flange and the vertical pivot axis, a ring-separation blocker appended to the elastic deflectable retainer tab and arranged to extend outwardly away from the elastic deflectable retainer tab and the vertical pivot axis to lie in spaced-apart relation to the top side of the post-support platform to define a ring-retaining space therebetween receiving the upper ring therein when the locking cap is in the locked position, and a tab-bender ramp appended to the elastic deflectable retainer tab to locate the ring-separation blocker between the post-support platform and the tab-bender ramp and configured to provide means for moving a free end of the elastic deflectable retainer tab inwardly toward the vertical pivot axis in response to movement of the upper ring downwardly toward the post-support platform and past the ring-separation blocker to reach the ring-receiving space and to establish the pivot joint between the first of the several wall units and the neighboring second of the several wall units, and wherein the locking cap includes a rotatable shell mounted for rotation about the vertical pivot axis and a first tab stop coupled to the rotatable shell to rotate therewith about the vertical pivot axis, the first tab stop is arranged to extend into the post-receiving channel formed in the upper ring of the second of the several wall units, and the first tab stop is arranged to engage the elastic deflectable retainer tab to block inward movement of the elastic deflectable retainer tab toward the vertical pivot axis upon arrival of the locking cap at the locked position and thereby block relative separation and rotation of the first and second of the several wall units.

15. The enclosure of claim 14, wherein the rotatable shell includes a shell wall arranged to surround the upper pivot post and a hand grip coupled to the shell wall to overlie the upper pivot post and to cooperate therewith to define a post-receiving space receiving a portion of the upper pivot post therein and the first tab stop is coupled to the hand grip and positioned to lie in spaced-apart relation to the shell wall to define a first ring-retainer space therebetween that is configured to receive a portion of the elastic deflectable retainer tab therein only when the locking cap arrives at the locked position.

16. The enclosure of claim 14, wherein the locking cap further includes a first anti-drift lug arranged to extend into a lug-receiving slot formed in the stationary flange of the upper pivot post upon arrival of the locking cap at the locked position to provide means for minimizing rotational drift movement of the locking cap about the vertical pivot axis while the locking cap is in the locked position.

17. The enclosure of claim 16, wherein the rotatable shell includes a shell wall arranged to surround the upper pivot post and a hand grip coupled to the shell wall to overlie the upper pivot post and to cooperate therewith to define a post-receiving space receiving a portion of the upper pivot post therein, the first tab stop is coupled to the hand grip and positioned to lie in spaced-apart relation to the shell wall to define a first ring-retainer space therebetween that is configured to receive a portion of the elastic deflectable retainer tab therein only when the locking cap arrives at the locked position, and the first anti-drift lug is coupled to the shell wall to rotate therewith about the vertical pivot axis.

18. The enclosure of claim 14, wherein the rotatable shell is formed to include a ring-separation blocker slot arranged to open into the post-receiving channel formed in the upper ring to allow the ring-separation blocker to extend from the elastic deflectable retainer tab through the ring-separation blocker slot to engage and retain the upper ring.

19. The enclosure of claim 14, wherein the rotatable shell is formed to include a status-indicator aperture arranged to open into the post-receiving channel so that a first indicator marking applied to the elastic deflectable retainer tab is visible through the status-indicator window to a nearby caregiver when the locking cap is in the locked position and a different second indicator marking applied to the stationary flange is visible through the status-indicator window to a nearby observer when the locking cap is in the unlocked position.

20. The enclosure of claim 1, wherein the upper ring in the female-edge connector of the second of the several wall units includes a circular inner wall and a series of inwardly projecting ratchet teeth coupled to the circular inner wall and arranged to cooperate with one another to form the post-receiving channel and to extend radially inwardly toward the upper pivot post and wherein a pocket formed between each pair of neighboring ratchet teeth is arranged to open radially inwardly toward the vertical pivot axis so as to receive a radially outwardly projecting ring-rotation blocker included in the pivot post to retain the first and the second of the several wall units in stationary positions relative to one another to establish a fixed included angle therebetween.

21. The enclosure of claim 1, wherein the movable first ring retainer of the upper pivot post includes an elastic deflectable retainer tab arranged to bend toward and away from the vertical pivot axis during movement of the upper pivot post into and out of the post-receiving channel, a ring-separation blocker coupled to the elastic deflectable retainer tab and arranged to extend away from the vertical pivot axis to lie between the upper ring and the exposed free tip of the upper pivot post when the locking cap is in the locked position, and a tab-bender ramp coupled to the elastic deflectable retainer tab and arranged to lie between the ring-separation blocker and the exposed free tip of the upper pivot post and to engage a lower edge of the upper ring during upward movement of the upper pivot post into the post-receiving channel to cause the elastic deflectable retainer tab to bend temporarily inwardly toward the vertical axis of rotation to allow the upper ring to lie under the ring-separation blocker without limiting rotation of the upper ring on the upper pivot post so that the first and second of the several wall units are free to pivot relative to one another about the vertical pivot axis at the option of the caregiver.

22. The enclosure of claim 21, wherein the upper ring in the female-edge connector of the second of the several wall units includes a circular inner wall and a series of inwardly projecting ratchet teeth coupled to the circular inner wall and arranged to cooperate with one another to form the post-receiving channel and to extend radially inwardly toward the upper pivot post and wherein a pocket formed between each pair of neighboring ratchet teeth is arranged to open radially inwardly toward the vertical pivot axis to cause the ring-rotation blocker coupled to the elastic deflectable retainer tab to snap radially outwardly into one of the pockets so that the included angle between the first and second of the several wall units is established and to allow the included angle to be varied by pivoting the second of the selected wall units relative to the first of the selected wall units while the locking cap is in the unlocked position to cause thering-rotation blocker of the upper pivot post to ride in ratcheting relation on the ratchet teeth of the upper ring as the elastic deflectable retainer tab is moved relative to the vertical pivot axis during ratcheting movement of the ring-rotation blocker on the ratchet teeth until the ring-rotation blocker extends into a selected different pocket.

23. The enclosure of claim 21, wherein the upper ring mount included in the male-edge connector of the first of the several wall units further includes a post-support platform arranged to extend away from a post side of the panel that is coupled to the male-edge connector of the first of the several wall units, the upper pivot post is coupled to the post-support platform and arranged to extend upwardly along the vertical pivot axis away from the ground underlying the panel of the first of the several wall units and lie in spaced-apart relation to the post side of the panel of the first of the several wall units, and the upper ring of the neighboring second of the several wall units is arranged to lie in a ring-receiving space provided between the post-support platform and the ring-separation blocker when the pivot joint is established.

24. A multi-sided security enclosure comprising:

several wall units adapted to be connected to one another in series to form a closed space, each wall unit including a female-edge connector including spaced-apart upper and lower rings, each of the upper and lower rings being formed to include a post-receiving channel, a male-edge connector arranged to lie in spaced-apart relation to the female-edge connector and including spaced-apart upper and lower ring mounts, each upper ring mount being associated with the upper ring in the female-edge connector of a neighboring wall unit, each lower ring mount being associated with the lower ring in the female-edge connector of the neighboring wall unit, and a panel arranged to extend between companion male- and female-edge connectors in a single wall unit and adapted to contact ground underlying the panel when a multi-sided security enclosure comprising the several wall units is erected, wherein an upper pivot post included in the upper ring mount of a first of the several wall units is arranged to extend into a post-receiving channel formed in the upper ring of a neighboring second of the several wall units to establish a pivot joint between the first and second of the several wall units so that the second of the several wall units is free to rotate about a vertical pivot axis relative to the first of the several wall units to vary the included angle therebetween at the option of a caregiver during assembly of the multi-sided security enclosure, wherein the upper pivot post included in the upper ring mount of the first of the several wall units includes a movable first ring retainer extending upwardly through the post-receiving channel formed in the upper ring of the neighboring second of the several wall units to a point above the upper ring surrounding the upper pivot post, and wherein the first of the wall units further includes a locking cap configured to provide means for rotating on an exposed free tip of the upper pivot post arranged to lie above the upper ring surrounding the upper pivot post at the option of an operator in one of a first ring-locking direction to assume a locked position arranged to block inward movement of the movable first ring retainer from an upright position blocking withdrawal of the upper pivot post from the post-receiving channel formed in the upper ring toward the vertical pivot axis to a deformed position allowing withdrawal of the upper pivot post from the post-receiving channel formed in the upper ring to facilitate separation of the first and second of the several wall units during disassembly of the multi-sided security enclosure and an opposite second ring-unlocking direction to assume an unlocked position freeing the movable first ring retainer to move from the upright position toward the vertical pivot axis to the deformed position during separating movement of the first of the several wall units relative to the second of the wall units to facilitate separation of the upper ring mount from the upper pivot post leading to separation of the first of the several wall units from the second of the several wall units, wherein the locking cap includes a shell mounted for rotation about the vertical pivot axis and a tab stop that is coupled to the shell to rotate therewith, in the locked position of the locking cap the tab stop is arranged to lie between an elastic deflectable retainer tab and the vertical pivot axis in confronting relation to an inner surface of the elastic deflectable retainer tab to block inward bending movement of a free end of the elastic deflectable retainer tab toward the vertical pivot axis, and in the unlocked position of the cap, the tab stop is moved away from the inner surface of the elastic deflectable retainer tab to allow inward bending movement of the free end of the elastic deflectable retainer tab toward the vertical pivot axis.

25. The enclosure of claim 24, wherein the upper ring in the female-edge connector of the second of the several wall units includes a circular inner wall and a series of inwardly projecting ratchet teeth coupled to the circular inner wall and arranged to cooperate with one another to form the post-receiving channel and to extend radially inwardly toward the upper pivot post, a pocket formed between each pair of neighboring ratchet teeth is arranged to open radially inwardly toward the vertical pivot axis so as to receive a radially outwardly projecting ring-rotation blocker included in the upper pivot post to retain the first and the second of the several wall units in stationary positions relative to one another to establish a fixed included angle therebetween, and in the locked position of the cap, the tab stop is arranged to block inward bending movement of the free end of the elastic deflectable retainer tab toward the vertical pivot axis so that the ring-rotation blocker is constrained to remain in a selected pocket and the upper ring is constrained to remaining a ring-retaining space provided under a ring-separation blocker coupled to the elastic deflectable retainer tab and arranged to extend away from the vertical pivot axis, and in the unlocked position of the cap and the tab stop is located to lie in spaced-apart relation to the inner surface of the elastic deflectable retainer tab to allow inward bending movement of the free end of the elastic deflectable retainer tab toward the vertical pivot axis to move the ring-separation blocker radially inwardly away from the upper ring and toward the vertical pivot axis so that ratcheting movement of the ring-rotation blocker on the upper pivot post on the ratchet teeth of the upper ring is allowed to facilitate pivotable movement of the second of the several wall units about the vertical pivot axis relative to the first of the several wall units so that the upper ring can be removed from the ring-retaining space to facilitate separation of the upper ring from the upper pivot post leading to separation of the first and second of the several wall units from one another.

* * * * *